US010151541B2

(12) United States Patent
Kim et al.

(10) Patent No.: US 10,151,541 B2
(45) Date of Patent: Dec. 11, 2018

(54) HEAT EXCHANGER FOR VEHICLE

(71) Applicants: HYUNDAI MOTOR COMPANY, Seoul (KR); Halla Visteon Climate Control Corp., Daejeon (KR)

(72) Inventors: Jae Yeon Kim, Hwaseong-si (KR); Ju Hoon Kim, Daejeon (KR); Hyun Keun Shin, Daejeon (KR)

(73) Assignees: HYUNDAI MOTOR COMPANY, Seoul (KR); HALLA VISTEON CLIMATE CONTROL CORP., Daejeon (KR)

( * ) Notice: Subject to any disclaimer, the term of this patent is extended or adjusted under 35 U.S.C. 154(b) by 450 days.

(21) Appl. No.: 14/737,315

(22) Filed: Jun. 11, 2015

(65) Prior Publication Data

US 2016/0161192 A1 Jun. 9, 2016

(30) Foreign Application Priority Data

Dec. 9, 2014 (KR) ..... 10-2014-0175825

(51) Int. Cl.
*F28F 3/08* (2006.01)
*F28D 9/00* (2006.01)
(Continued)

(52) U.S. Cl.
CPC ..... *F28D 9/005* (2013.01); *F25B 40/00* (2013.01); *F28D 2021/008* (2013.01); *F28D 2021/0068* (2013.01); *F28F 2265/28* (2013.01)

(58) Field of Classification Search
CPC .. F28D 9/005; F28D 9/00; F25B 40/00; F25B 2500/12; F25B 2500/13; B60H 2001/006; F28F 2265/28
See application file for complete search history.

(56) References Cited

U.S. PATENT DOCUMENTS 7,219,717 B2 5/2007 Hanafusa
2003/0155108 A1* 8/2003 Shinohara ..... B60K 6/48 165/146

(Continued)

FOREIGN PATENT DOCUMENTS

JP 08-110122 A 4/1996
JP 2000-265834 A 9/2000

(Continued)

*Primary Examiner* — Len Tran
*Assistant Examiner* — Kamran Tavakoldavani
(74) *Attorney, Agent, or Firm* — McDermott Will & Emery LLP

(57) ABSTRACT

A heat exchanger for a vehicle includes a heat exchange unit in which a plurality of plates are layered to alternately form a first flow channel and a second flow channel therein and heat exchange unit having one surface fixedly mounted in an expansion valve. First and second inflow holes are formed separately at both surfaces of the heat exchange unit and connected to the first flow channel and the second flow channel, respectively. First and second exhaust holes are formed separately in a diagonal direction of the first and second inflow holes at both surfaces of the heat exchange unit and connected to the first flow channel and the second flow channel, respectively. A noise reducer is integrally connected to the heat exchange unit at another surface of the heat exchange unit and reduces noise and vibration occurring when an operation fluid that is injected through the second inflow hole moves.

7 Claims, 19 Drawing Sheets

(51) Int. Cl.
*F25B 40/00* (2006.01)
*F28D 21/00* (2006.01)

(56) References Cited

U.S. PATENT DOCUMENTS

| | | | | |
|---|---|---|---|---|
| 2009/0120610 | A1* | 5/2009 | Coyle | B60H 1/00321 165/67 |
| 2010/0243200 | A1 | 9/2010 | Baker, Jr. et al. | |
| 2011/0088968 | A1 | 4/2011 | Kempf et al. | |
| 2012/0097365 | A1* | 4/2012 | Papoulis | F28D 9/005 165/61 |
| 2012/0247145 | A1* | 10/2012 | Denoual | F28D 9/0006 62/498 |
| 2013/0092359 | A1* | 4/2013 | Von Eckermann | F28D 9/0043 165/165 |
| 2013/0160972 | A1* | 6/2013 | Sheppard | F28F 27/00 165/96 |
| 2015/0276328 | A1* | 10/2015 | Huang | F25B 40/00 165/164 |

FOREIGN PATENT DOCUMENTS

| | | | |
|---|---|---|---|
| JP | 2003-343994 | A | 12/2003 |
| JP | 2011-007463 | A | 1/2011 |
| JP | 2015-017749 | A | 1/2015 |
| KR | 10-2012-0030076 | A | 3/2012 |
| KR | 10-2014-0044671 | A | 4/2014 |
| KR | 10-2014-0053702 | A | 5/2014 |
| KR | 10-1416358 | B1 | 7/2014 |

* cited by examiner

HEAT EXCHANGER FOR VEHICLE

CROSS-REFERENCE TO RELATED APPLICATION

This application claims the benefit of priority to Korean Patent Application No. 10-2014-0175825 filed in the Korean Intellectual Property Office on Dec. 9, 2014, the entire content of which is incorporated herein by reference.

TECHNICAL FIELD

The present disclosure relates to a heat exchanger for a vehicle. More particularly, the present disclosure relates to a heat exchanger for a vehicle, which is mounted in an integral form in an expansion valve, capable of improving air conditioning performance and reducing noise and vibration occurring when a refrigerant moves.

BACKGROUND

In general, a vehicle has an air conditioning system to maintain a vehicle indoor temperature at a desired temperature regardless of an outside temperature.

Such an air conditioning system includes: in general, a compressor that compresses a refrigerant; a condenser that condenses and liquefies the compressed refrigerant; an expansion valve that quickly expands the condensed and liquefied refrigerant; and an evaporator that cools air that is supplied to an interior of a vehicle in which the air conditioning system is installed using evaporation latent heat of the refrigerant while evaporating the refrigerant.

The air conditioning system operates according to a general cooling cycle and performs an air conditioning process by a continuous phase change from a liquid state of a high temperature and a high pressure to a gas state of a low temperature and a low pressure while sequentially repeating circulation the refrigerant through an air conditioner pipe that connects the compressor, the condenser, the expansion valve, and the evaporator.

However, the conventional air conditioning system has a structure supercooling the condensed refrigerant, and thus a pressure drop frequently occurs inside a condenser inlet and outlet pipe due to complex refrigerant flow.

Further, because the condenser has a limited size therein and internal space of an engine compartment is small, a length of an air conditioner pipe in which a refrigerant moves is restricted. Accordingly, a minimum required length for reducing the refrigerant to a necessary temperature is not satisfied and a coefficient of performance (COP), which is a coefficient of air conditioning ability to compressor power consumption, is thus lowered, thus deteriorating the overall air conditioning performance and efficiency of the air conditioning system.

Further, since the refrigerant that circulates through the air conditioning system is compressed at the high temperature and the high pressure through the compressor in the air conditioner pipe at a fast speed, noise and vibration occur in the air conditioner pipe, thus deteriorating the overall noise, vibration, and harshness (NVH) performance of the vehicle.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide a heat exchanger for a vehicle, which is mounted in an integral form in an expansion valve, capable of improving air conditioning performance of an air conditioning system by supercooling through heat exchange of a refrigerant having a high temperature and a high pressure supplied from a condenser and a refrigerant having a low temperature and a low pressure supplied from an evaporator to a compressor, and improving NVH performance of the vehicle by reducing noise and vibration occurring when the refrigerant moves.

According to an exemplary embodiment of the present inventive concept, a heat exchanger for a vehicle includes a heat exchange unit in which a plurality of plates are layered to alternately form a first flow channel and a second flow channel therein to exchange heat of operation fluids passing through each of the first and second flow channels and that has one surface that is connected to an expansion valve. First and second inflow holes are formed separately at both surfaces of the heat exchange unit and connected to the first flow channel and the second flow channel, respectively. First and second exhaust holes are formed separately in a diagonal direction of the first and second inflow holes at both surfaces of the heat exchange unit and connected to the first flow channel and the second flow channel, respectively. A noise reducer is integrally connected to another surface of the heat exchange unit and reduces noise and vibration occurring when an operation fluid that is injected through the second inflow hole moves.

The noise reducer may include+ at least two noise reduction plates layered at the other surface of the heat exchange unit, forming at least one space therein, and having a connection hole which communicates with the second exhaust hole. A closing and sealing plate is mounted to an outer side of in the at least two noise reduction plates to form a space between the closing and sealing plate and the outer side of the at least two noise reduction plates.

The at least one space may block the connection of the first flow channel and the first inflow hole to inject only an operation fluid that is discharged through the second exhaust hole.

The noise reducer may include at least one noise reduction plate having one surface layered at the other surface of the heat exchange unit, having a protruding end which protrudes toward the other surface, and having a connection hole which communicates with the second exhaust hole. A resonance hole in which one side of the protruding end is opened communicates with the connection hole. A closing and sealing plate is mounted to an outer side of the at least one noise reduction plate to be in contact with the protruding end and forming a space which communicates with the resonance hole between the closing and sealing plate and the at least one noise reduction plate.

The space may block the connection of the first flow channel and the first inflow hole to inject only an operation fluid that is discharged through the second exhaust hole.

At each of one surface of the heat exchange unit and the other surface of the noise reduction unit, a cover plate may be mounted. At the cover plate, that is located at an opposite side of the expansion valve, a connection block having first and second penetration holes that communicate with the first inflow hole and the second exhaust hole, respectively, may be mounted.

The expansion valve may be connected to the heat exchange unit through a connection flange that is mounted to the heat exchange unit by a fixed plate, and may be integrally fixed to the heat exchange unit through a fixing bolt that penetrates the heat exchange unit from the other surface of the heat exchange unit.

The first inflow hole may be formed at the other surface of the heat exchange unit, and the first exhaust hole may be formed separately in a diagonal direction of the first inflow hole at the one surface of the heat exchange unit. The second inflow hole may be formed at the one surface of the heat exchange unit, and the second exhaust hole may be formed separately in a diagonal direction of the second inflow hole at the other surface of the heat exchange unit.

The operation fluid may include a first refrigerant of a high temperature and a high pressure that is discharged from a condenser to pass through each first flow channel through the first inflow hole, and a second refrigerant of a low temperature and a low pressure that is discharged from an evaporator to pass through each second flow channel through the second inflow hole.

According to another embodiment of the present inventive concept, a heat exchanger for a vehicle includes a heat exchange unit in which a plurality of plates are layered to alternately form a first flow channel and a second flow channel therein and that exchanges heat of operation fluids that pass through each of the first and second flow channels. First and second inflow holes are formed separately at both surfaces of the heat exchange unit and connected to the first flow channel and the second flow channel, respectively. First and second exhaust holes are formed separately in a diagonal direction of the first and second inflow holes at both surfaces of the heat exchange unit and connected to the first flow channel and the second flow channel, respectively. An expansion valve is connected to the heat exchange unit at one surface of the heat exchange unit. A noise reducer is integrally connected to the one surface of the heat exchange unit between the heat exchange unit and the expansion valve and reduces noise and vibration occurring when an operation fluid that is injected through the second inflow hole moves.

The noise reduction unit may include at least two noise reduction plates layered at the one surface of the heat exchange unit between the heat exchange unit and the expansion valve to form at least one space therein. A connection hole is formed in the at least two noise reduction plates and allows the operation fluid to be injected into the second inflow hole to pass through the at least one space and into the second flow channel through the second inflow hole.

The space may block the connection of the first flow channel, the first inflow hole, and the first exhaust hole to allow an operation fluid that is injected through the connection hole to pass through and to allow the operation fluid that is injected through the second inflow hole to pass through the second flow channel.

The noise reducer may include: at least one noise reduction plate layered at the one surface of the heat exchange unit between the heat exchange unit and the expansion valve to form a space therein, having a protruding end which protrudes toward the one surface of the heat exchange unit, and having a connection hole which communicates with the second inflow hole. A resonance hole has the protruding end at an edge thereof so that the connection hole and the space communicate with each other.

The space may block the connection of the first flow channel, the first inflow hole, and the first exhaust hole to inject only the operation fluid that is injected into the second inflow hole to pass through the second flow channel and that is moved to the second exhaust hole.

The expansion valve may be connected to the heat exchange unit through a connection flange to the noise reducer by a fixed plate, and may be integrally fixed to the heat exchange unit with the noise reducer interposed therebetween through a fixing bolt which penetrates the heat exchange unit and the noise reducer from another surface of the heat exchange unit.

At each of the other surface of the heat exchange unit and one surface of the noise reduction unit, a cover plate may be mounted. A closing and sealing plate, which prevents the operation fluids from being leaked, may be mounted between the other surface in which the cover plate is mounted and the plurality of plates.

In the cover plate that is located at an opposite side of the expansion valve, a connection block that has each of first and second penetration holes that are communicated with the first inflow hole and the second exhaust hole may be mounted to the heat exchange unit.

The first inflow hole may be formed at another surface of the heat exchange unit, and the first exhaust hole may be formed separately in a diagonal direction of the first inflow hole at the one surface of the heat exchange unit. The second inflow hole may be formed at the one surface of the heat exchange unit, and the second exhaust hole may be formed separately in a diagonal direction of the second inflow hole at the other surface of the heat exchange unit.

The operation fluids may include a first refrigerant of a high temperature and a high pressure that is discharged from a condenser to pass through each first flow channel through the first inflow hole and a second refrigerant of a low temperature and a low pressure that is discharged from an evaporator to pass through each second flow channel through the second inflow hole.

DETAILED DESCRIPTION OF THE EMBODIMENTS

Figure 1:
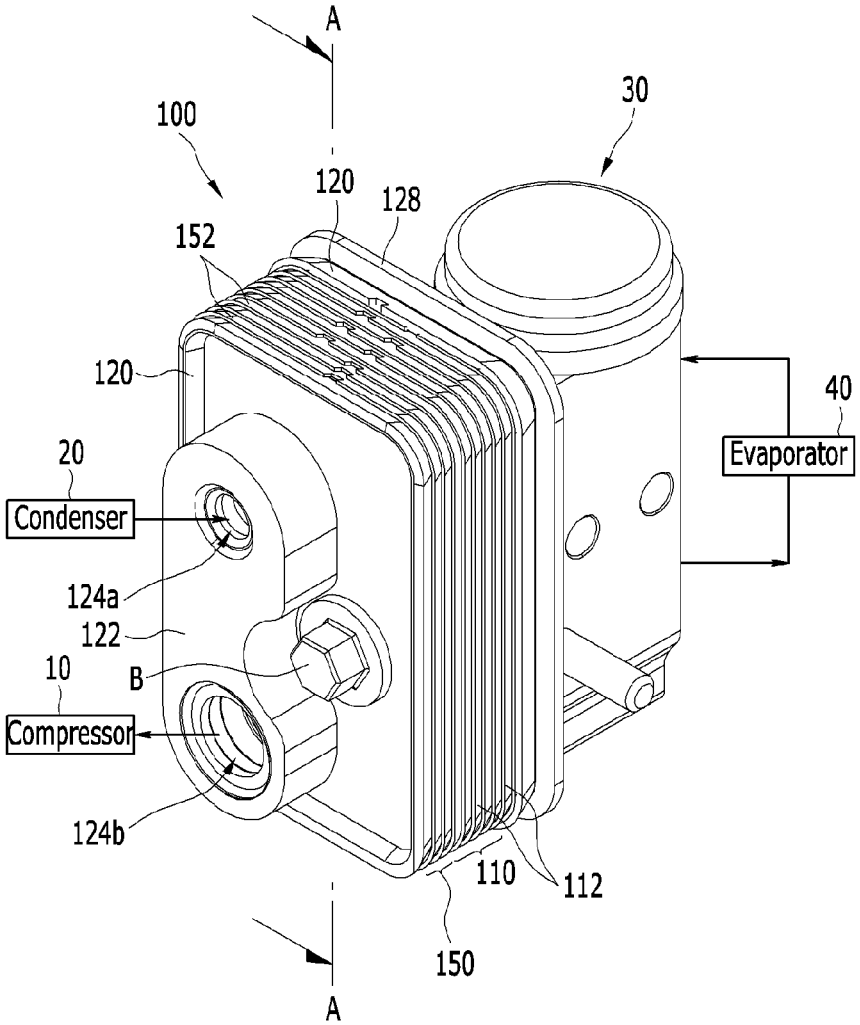
FIG. 1 is a perspective view illustrating a heat exchanger for a vehicle according to a first exemplary embodiment of the present inventive concept.

An exemplary embodiment of the present inventive concept will hereinafter be described in detail with reference to the accompanying drawings.

An embodiment described in this specification and a configuration shown in the drawing is merely an exemplary embodiment of the present inventive concept and do not represent an entire technical idea of the present disclosure, and thus, it should be understood that various equivalents and exemplary variations that can replace the exemplary embodiment may exist at an application time point of the present disclosure.

The drawings and description are to be regarded as illustrative in nature and not restrictive. Like reference numerals designate like elements throughout the specification.

Further, in the drawings, a size and thickness of each element are randomly represented for better understanding and ease of description, the present disclosure is not limited thereto, and the thickness of several portions and areas are exaggerated for clarity.

In the entire specification, unless explicitly described to the contrary, the word "comprise" and variations such as "comprises" or "comprising" will be understood to imply the inclusion of stated elements but not the exclusion of any other elements.

In addition, the terms " . . . unit," " . . . means," "-er," and "member" described in the specification mean a unit of a configuration for processing at least one function and operation.

Figure 2:
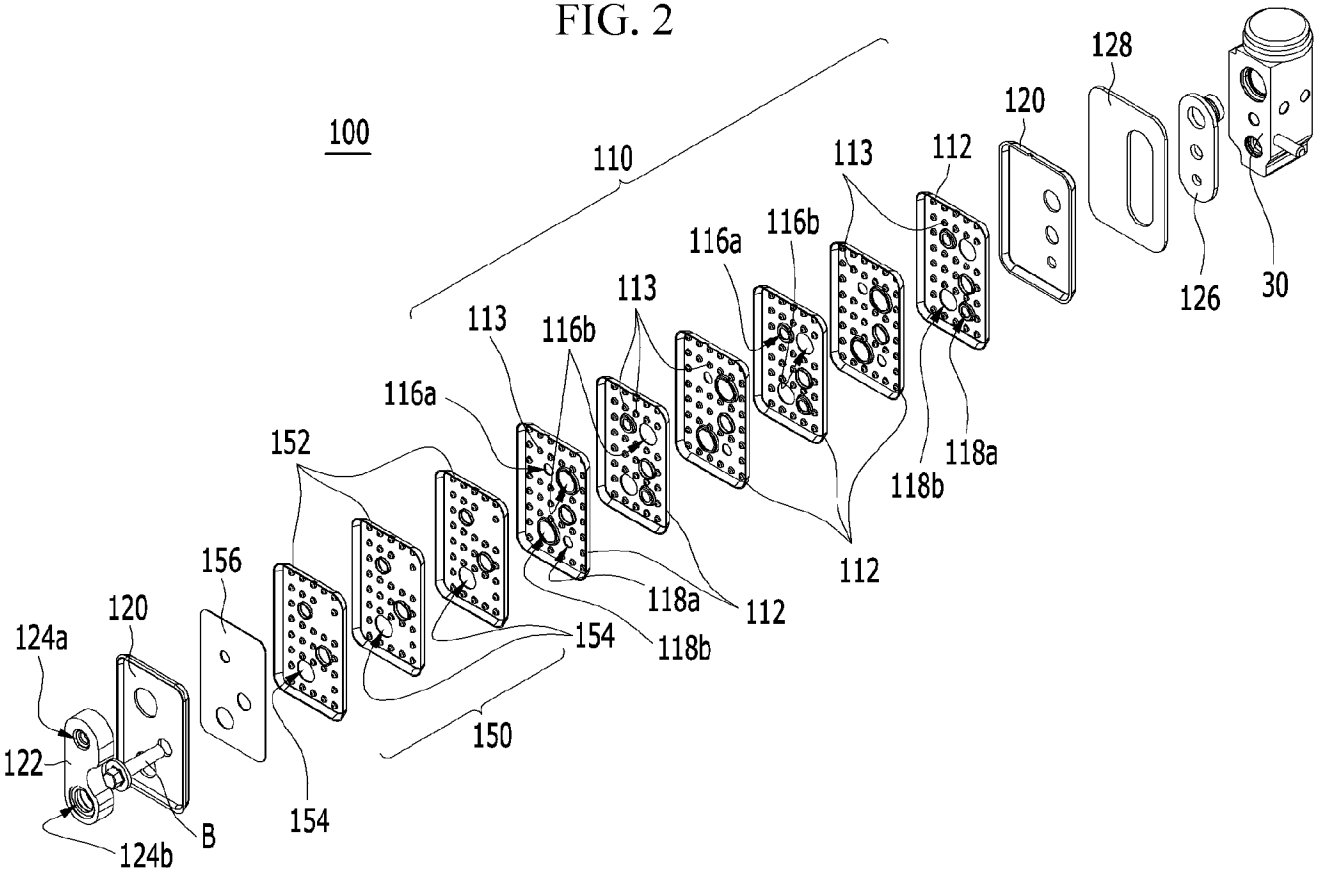
FIG. 2 is an exploded perspective view illustrating the heat exchanger for a vehicle according to the first exemplary embodiment of the present inventive concept.
Figure 3:
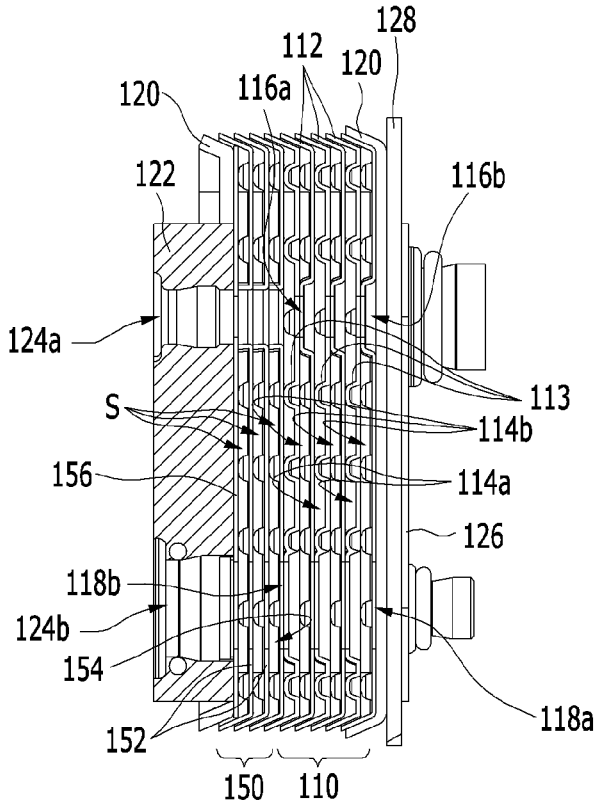
FIG. 3 is a cross-sectional view taken along the line A-A of FIG. 1.

FIGS. 1 and 2 are a perspective view and an exploded perspective view illustrating a heat exchanger for a vehicle according to a first exemplary embodiment of the present inventive concept, respectively, and FIG. 3 is a cross-sectional view taken along the line A-A of FIG. 1.

A vehicle heat exchanger 100 according to a first exemplary embodiment of the present inventive concept is directly mounted to an expansion valve 30 and disposed between a condenser 20 and the expansion valve 30 in an air conditioning system. The air conditioning system includes a compressor 10 that compresses a refrigerant, the condenser 20 that condenses the refrigerant, and the expansion valve 30 that expands the condensed refrigerant. An evaporator 40 evaporates the expanded refrigerant through heat exchange with air, and exchanges heat of the refrigerant, which is an operation fluid supplied to inside the vehicle heat exchanger 100.

As shown in FIGS. 1 to 3, the vehicle heat exchanger 100 according to a first exemplary embodiment of the present inventive concept includes a heat exchange unit 110, first and second inflow holes 116*a* and 116*b*, first and second exhaust holes 118*a* and 118*b*, and a noise reducer 150.

In the heat exchange unit 110, a plurality of plates 112 are layered to alternately form a first flow channel 114*a* and a second flow channel 114*b* therein. The heat exchange unit 110 exchanges heat of operation fluids that pass through each of the first and second flow channels 114*a* and 114*b*.

One surface of the heat exchanger 110 is fixedly mounted to the expansion valve 30. Here, a cover plate 120 may be mounted at each of another surface of the heat exchange unit 110 and another surface of the noise reducer 150.

The heat exchange unit 110 may have a plate shape in which the plurality of plates 112 are layered.

In the first exemplary embodiment, the first inflow hole 116*a* and the second inflow hole 116*b* are formed separately at both surfaces of the heat exchange unit 110 and communicate with the first flow channel 114*a* and the second flow channel 114*b*, respectively.

The first exhaust hole 118*a* and the second exhaust hole 118*b* are formed separately in a diagonal direction of the first and second inflow holes 116*a* and 116*b* at both surfaces of the heat exchange unit 110 and communicated with the first flow channel 114*a* and the second flow channel 114*b*, respectively.

That is, the first inflow hole 116*a* may be formed at the other surface of the heat exchange unit 110, and the first exhaust hole 118*a* may be formed at a separated location in a diagonal direction of the first inflow hole 116*a* at the one surface of the heat exchange unit 110. The second inflow hole 116*b* may be formed at the one surface of the heat exchange unit 110, and the second exhaust hole 118*b* may be formed at a separated location in a diagonal direction of the second inflow hole 116*b* at another side of the other surface of the heat exchange unit 110.

Accordingly, the operation fluids passing through the first and second flow channels 114*a* and 114*b* through the first and second inflow holes 116*a* and 116*b*, respectively, counterflow each other to change the heat in the heat exchange unit 110.

Further, a connection block 122, which includes first and second penetration holes 124*a* and 124*b* communicating with the first inflow hole 116*a* and the second exhaust hole 118*b*, respectively, may be mounted to the cover plate 120 at an opposite side of the expansion valve 30.

The connection block 122 enables easy connection of pipes for connecting the compressor 10 or the evaporator 40 with the heat exchanger 100, thereby improving assembling efficiency and reducing a pipe mounting time.

Further, the expansion valve 30 is connected to the heat exchange unit 110 through a connection flange 126. The connection flange 126 is fixed to the heat exchange unit 110 through a fixing bolt B that penetrates and is engaged to an inner side of the heat exchange unit 110 from the other surface of the heat exchange unit 110.

The connection flange 126 may be mounted through a fixed plate 128 to the heat exchange unit 110. Accordingly, the heat exchange unit 110 is directly mounted through the connection flange 126 at one surface of the expansion valve 30 to be integrally formed with the expansion valve 30.

In the first exemplary embodiment, the plurality of plates 112 may include at least one protrusion 113 protruding from an inner side of the first and second flow channels 114*a* and 114*b*.

The at least one protrusion 113 controls flow of the operation fluids to uniformly flow over the first flow channel 114*a* and the second flow channel 114*b* entirely by detouring the operation fluids passing through each of the first flow channel 114*a* and the second flow channel 114*b*.

That is, when the operation fluids are injected into each of the first inflow hole 116*a* and the second inflow hole 116*b* and pass through the first flow channel 114*a* and the second flow channel 114*b*, the at least one protrusion 113 allows the operation fluids to entirely move to each of the flow channels 114*a* and 114*b*, thereby increasing a heat exchange area and improving efficiency.

The operation fluids may be formed with a refrigerant of a high temperature and a high pressure that is discharged from the condenser 20 to pass through each of the first flow channels 114*a* through the first inflow hole 116*a* as a first refrigerant, and a refrigerant at a low temperature and a low pressure that is discharged from the evaporator 40 to pass through each of the second flow channels 114*b* through the second inflow hole 116*b* as a second refrigerant.

In the first exemplary embodiment, heat exchange unit 110 have two flow channels, inflow holes, and exhaust holes, but the present disclosure is not limited thereto, and the number of the flow channels, the inflow holes, and the exhaust holes may be changed and applied according to the number of injected operation fluids.

For example, when the operation fluids further include a coolant, a new flow channel may be formed and inflow and exhaust holes that are connected to the new flow channel may be formed by increasing the number of the plates 112.

The noise reducer 150 is integrally formed with the heat exchange unit 110 at another surface of the heat exchange unit 110, which reduces noise and vibration occurring when the second refrigerant is injected through the second inflow hole 116*b* and moves. The noise reducer 150 includes a noise reduction plate 152 and a closing and sealing plate 156.

In the first exemplary embodiment, the noise reduction plate 152 may be three pieces. However, it is not limited thereto such that the noise reduction plate 152 may be at least two pieces.

The noise reduction plate 152 is layered at the other surface of the heat exchange unit 110 and includes at least one space S, which blocks the connection to the first inflow hole 116*a* and the first flow channel 114*a*, and a connection hole 154 which communicates with the second exhaust hole 118*b* inside the noise reduction plate 152.

The closing and sealing plate 156 is mounted to the noise reduction plate 152 and disposed at the opposite side of the expansion valve 30. The closing and sealing plate 156 forms the space S between the closing and sealing plate 156 and the noise reduction plate 152.

Accordingly, in the first exemplary embodiment, when there are three noise reduction plate 152 layered in the heat exchange unit 110, the noise reducer 150 forms three spaces therein while the closing and sealing plate 156 is mounted to the noise reduction plate 152.

Here, the three spaces S may block the connection to the first inflow hole 116*a* and the first flow channel 114*a* in order to inject only the second refrigerant.

The noise reducer 150 is installed in an expansion muffler that reflects noise and vibration occurring while the second refrigerant moves through the second exhaust hole 118*b* having a smaller cross-sectional area than that of the spaces S due to a difference in the cross-sectional areas.

By integrally forming the noise reducer 150 in the heat exchange unit 110, a separate muffler or a long air conditioner pipe for reducing noise and vibration can be eliminated.

Hereinafter, an operation of the heat exchanger 100 for a vehicle according to a first exemplary embodiment of the present inventive concept will be described in detail.

Figure 4:
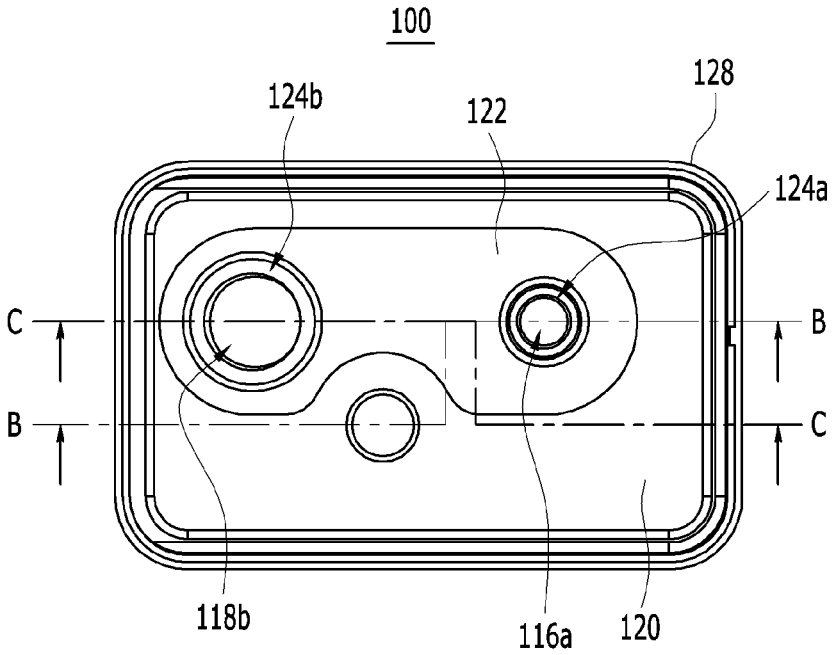
FIG. 4 is a top plan view illustrating the heat exchanger for a vehicle according to the first exemplary embodiment of the present inventive concept.
Figure 5:
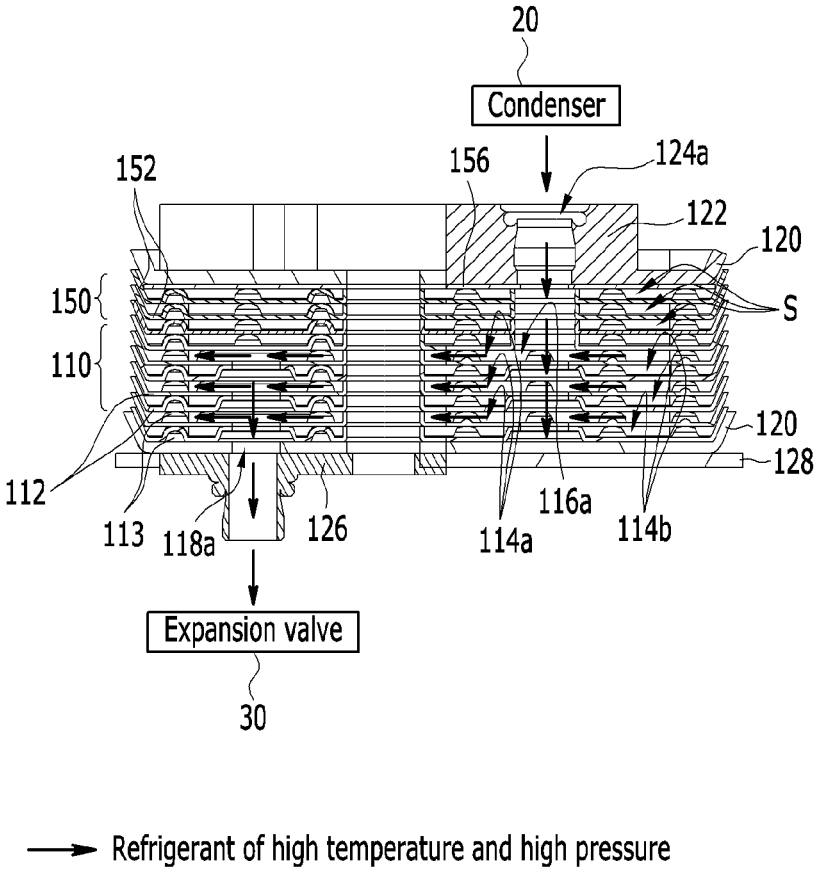
FIG. 5 is a cross-sectional view taken along the line B-B of FIG. 4 illustrating a moving state of a refrigerant that is discharged from a condenser.
Figure 6:
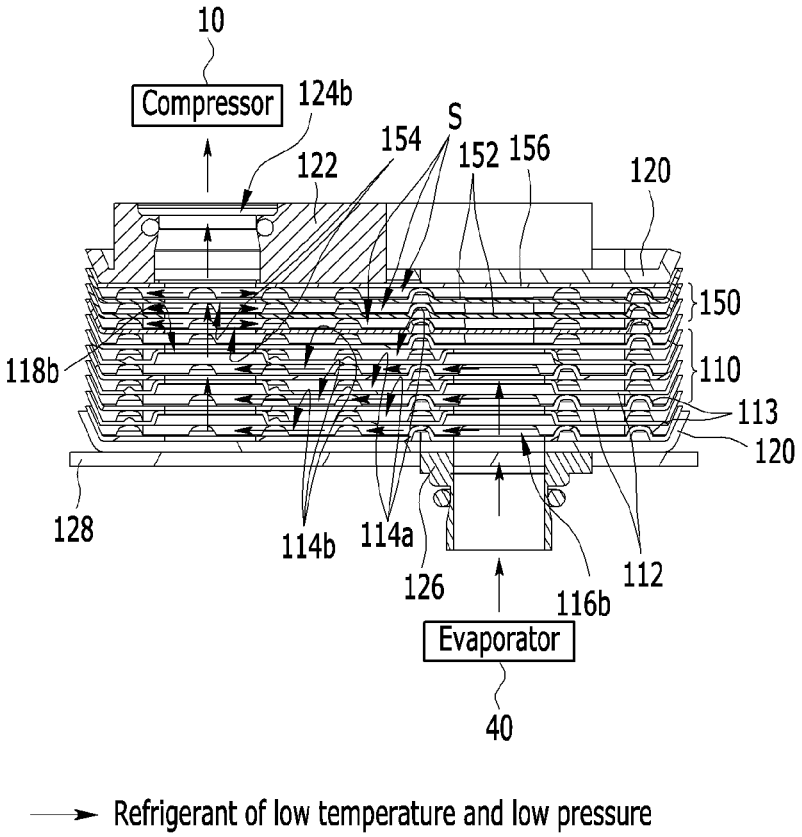
FIG. 6 is a cross-sectional view taken along the line C-C of FIG. 4 illustrating a moving state of a refrigerant that is discharged from an evaporator.

FIG. 4 is a top plan view illustrating the heat exchanger for a vehicle according to the first exemplary embodiment of the present inventive concept, FIG. 5 is a cross-sectional view taken along the line B-B of FIG. 4 illustrating a moving state of a refrigerant that is discharged from a condenser, and FIG. 6 is a cross-sectional view taken along the line C-C of FIG. 4 illustrating a moving state of a refrigerant that is discharged from an evaporator.

Referring to FIG. 5, the first refrigerant that is condensed in the condenser 20 is injected through the first penetration hole 124*a* formed in the connection block 122 of the heat exchanger 100.

The first refrigerant that is injected into the first penetration hole 124*a* is injected into the first inflow hole 116*a* through the noise reducer 150, and is discharged to the expansion valve 30 through the first exhaust hole 118*a* by passing through each first flow channel 114*a*.

Since each space S formed in the noise reducer 150 is blocked from the first flow channel 114*a* and the first inflow hole 116*a*, the first refrigerant injected into the heat exchange unit 110 exchanges heat with the second refrigerant that passes through each second flow channel 114*b* when it does not pass through each space S, thereby supercooling.

As shown in FIG. 6, the second refrigerant discharged from the evaporator 40 is injected into the second inflow hole 116*b* to exchange the heat with the first refrigerant passing through each first flow channel 114*a* and each second flow channel 114*b*. The second refrigerant is then injected into each space S of the noise reducer 150 through the second exhaust hole 118*b*.

The second refrigerant is discharged through the second exhaust hole 118*b* and moves from the second exhaust hole 118*b* having a smaller cross-sectional area than that of each space S.

Here, the noise reducer 150 performs a function of an expansion muffler that reflects noise and vibration by a difference in the cross-sectional areas, thus reducing noise and vibration that is generated in the second refrigerant that is discharged through the second exhaust hole 118*b*.

The heat exchanger 100 for a vehicle according to the first exemplary embodiment is directly mounted in the expansion valve 30, and therefore, the heat exchanger 100 can reduce the noise and vibration occurring when the second refrigerant moves by integrally forming the noise reducer 150 together with the heat exchange unit 110.

Further, the heat exchange unit 110 supercools the first refrigerant with the second refrigerant through the heat exchange, thus a non-condensable refrigerant that is included in the first refrigerant is injected into the expansion valve 30 in a condensed state through the heat exchange.

Accordingly, the heat exchanger 100 additionally reduces a temperature of a refrigerant of an inlet side of the evaporator 40 and makes a large enthalpy difference of the evaporator 40, thereby maximizing a coefficient of performance (COP).

Further, the heat exchanger 100 according to the first exemplary embodiment prevents efficiency of the air conditioning system from being deteriorated by a non-condensable gas refrigerant, thereby increasing expansion efficiency in the expansion valve 30.

Figure 7:
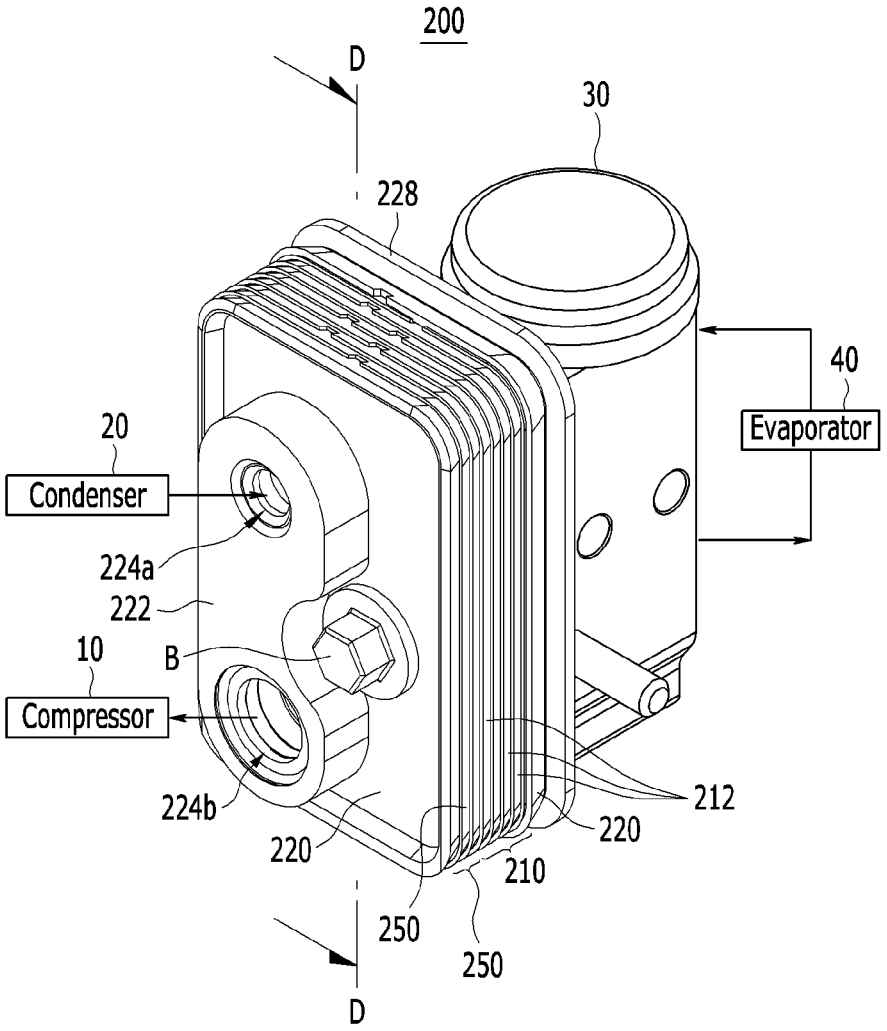
FIG. 7 is a perspective view illustrating a heat exchanger for a vehicle according to a second exemplary embodiment of the present inventive concept.
Figure 8:
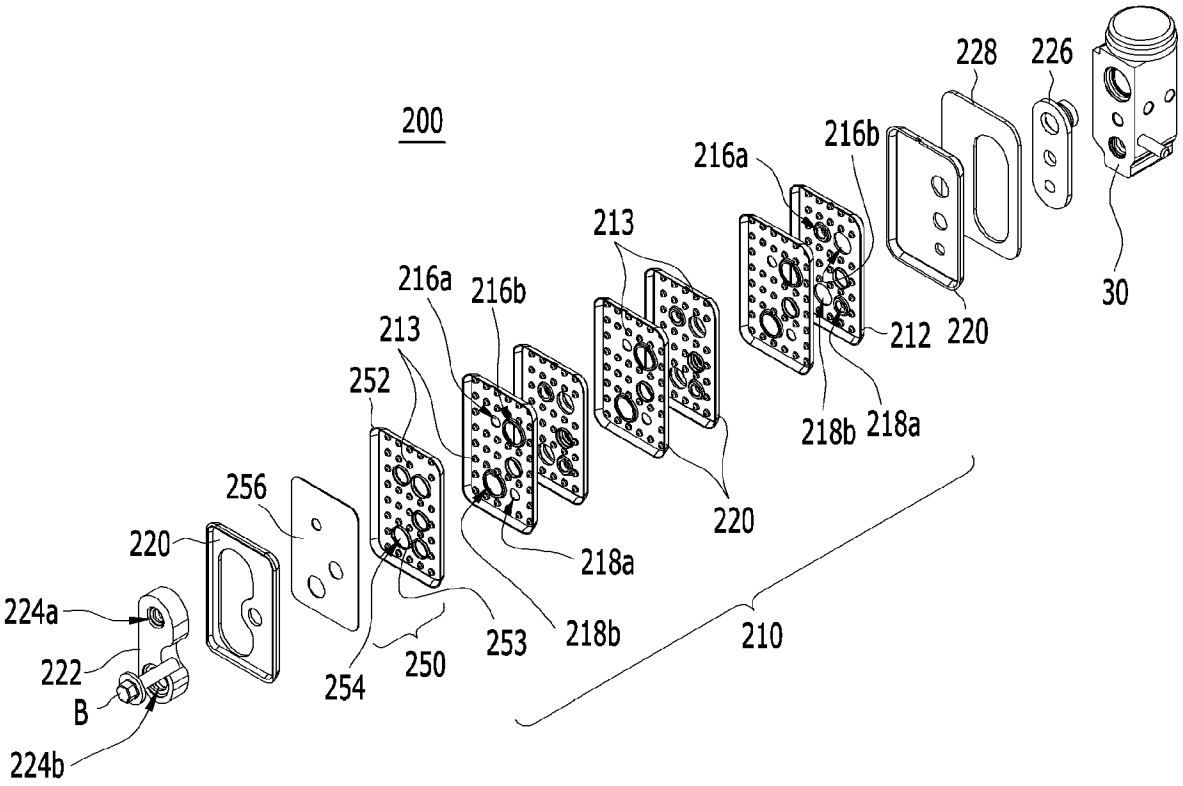
FIG. 8 is an exploded perspective view illustrating the heat exchanger for a vehicle according to the second exemplary embodiment of the present inventive concept.
Figure 9:
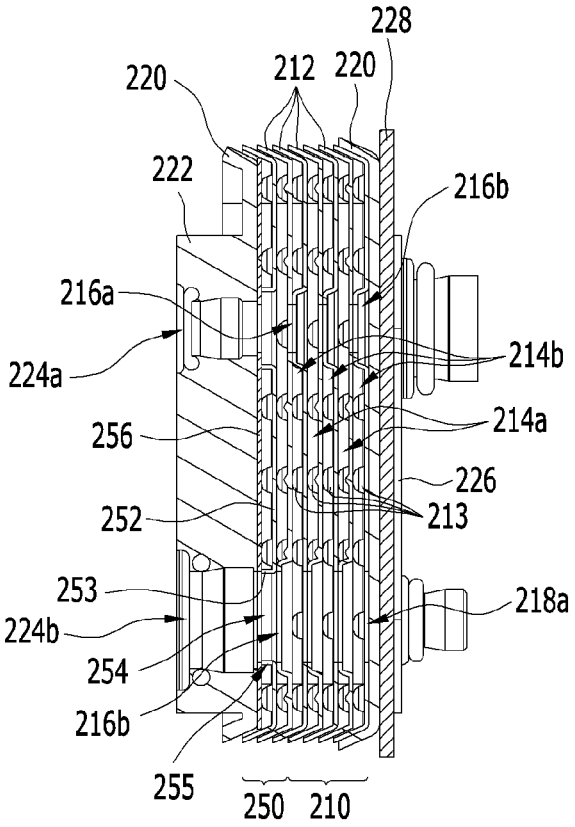
FIG. 9 is a cross-sectional view taken along the line D-D line of FIG. 7.
Figure 10:
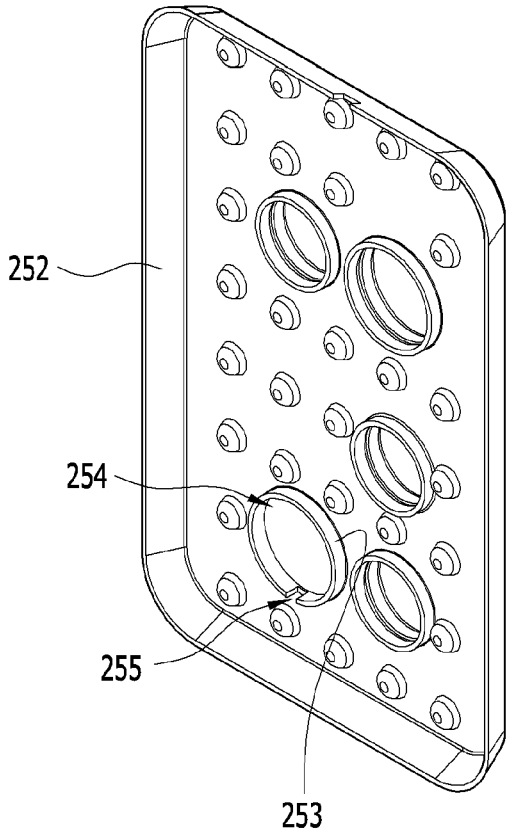
FIG. 10 is a perspective view illustrating a noise reduction plate that is applied to a noise reduction unit in a heat exchanger for a vehicle according to the second exemplary embodiment of the present inventive concept.

FIGS. 7 and 8 are a perspective view and an exploded perspective view illustrating a heat exchanger for a vehicle according to a second exemplary embodiment of the present inventive concept, respectively, FIG. 9 is a cross-sectional view taken along the line D-D line of FIG. 7, and FIG. 10 is a perspective view illustrating a noise reduction plate that is applied to a noise reduction unit in the heat exchanger for a vehicle according to a second exemplary embodiment of the present inventive concept.

A vehicle heat exchanger 200 according to a second exemplary embodiment is directly mounted in an expansion valve 30 between a condenser 20 and the expansion valve 30 in an air conditioning system. The air conditioning system includes a compressor 10 that compresses a refrigerant, the condenser 20 that condenses a refrigerant, and the expansion valve 30 that expands the condensed refrigerant. An evaporator 40 evaporates the expanded refrigerant through heat exchange with air and exchanges heat of a refrigerant, which is an operation fluid injected into inside the vehicle heat exchanger 200.

As shown in FIGS. 7 to 9, the vehicle heat exchanger 200 according to a second exemplary embodiment of the present inventive concept includes a heat exchange unit 210, first and second inflow holes 216*a* and 216*b*, first and second exhaust holes 218*a* and 218*b*, and a noise reducer 250.

The heat exchange unit 210 has a plurality of plates 212 layered to alternately form a first flow channel 214*a* and a second flow channel 214*b* therein, and the heat exchange unit 210 exchanging heat of operation fluids that pass through each of the first and second flow channels 214*a* and 214*b*.

One surface of the heat exchange unit 210 is fixedly mounted to the expansion valve 30. Further, a cover plate 220 may be mounted to each of one surface of the heat exchange unit 210 and the noise reducer 250.

The heat exchange unit 210 may have a plate shape in which the plurality of plates 212 are layered.

In the second exemplary embodiment, the first inflow hole 216*a* and the second inflow hole 216*b* are formed separately at both surfaces of the heat exchange unit 210 and connected to the first flow channel 214*a* and the second flow channel 214*b*, respectively.

The first exhaust hole 218*a* and the second exhaust hole 218*b* are formed separately in a diagonal direction of the first and second inflow holes 216*a* and 216*b* at both surfaces of the heat exchange unit 210 and connected to the first flow channel 214*a* and the second flow channel 214*b*, respectively.

That is, the first inflow hole 216*a* is formed at the other surface of the heat exchange unit 210, and the first exhaust hole 218*a* may be formed at the one surface of the heat exchange unit 210 in a diagonal direction of the first inflow hole 216*a*. The second inflow hole 216*b* is formed at the one surface of the heat exchange unit 210, and the second exhaust hole 218*b* may be formed at the other surface of the heat exchange unit 210 in a diagonal direction of the second inflow hole 216*b*.

Accordingly, the heat exchange unit 210 may exchange the heat as the operation fluids, which pass through the first and second flow channels 214*a* and 214*b*, counterflow.

In a second exemplary embodiment, a connection block 222 may be mounted in the cover plate 220 that is located at an opposite side of the expansion valve 30. The connection block 222 has first and second penetration holes 224*a* and 224*b* communicating with the first inflow hole 216*a* and the second exhaust hole 218*b*, respectively.

The connection block 222 enables easy connection of pipes for connecting the compressor 10 or the evaporator 40 to the heat exchanger 100, thereby improving assembling efficiency.

Further, the expansion valve 30 is connected to the heat exchange unit 210 through a connection flange 226. The connection flange 226 is mounted in the heat exchange unit 210 and integrally fixed to the heat exchange unit 210 through a fixing bolt B that penetrates and is engaged to an inner side of the heat exchange unit 210.

The connection flange 226 may be mounted in the heat exchange unit 210 through a fixed plate 228. Accordingly, the heat exchange unit 210 is directly mounted through the connection flange 226 at one surface of the expansion valve 30 to be integrally formed with the expansion valve 30.

In a second exemplary embodiment, the plurality of plates 212 may include at least one protrusion 213 protruding from an inner side of the first and second flow channels 214*a* and 214*b*.

The at least one protrusion 213 controls movement of the operation fluids to uniformly flow over the first flow channel 214*a* and the second flow channel 214*b* entirely by detouring the operation fluids that pass through each of the first flow channel 214*a* and the second flow channel 214*b*.

That is, when the operation fluids are injected into the first inflow hole 216*a* and the second inflow hole 216*b* and pass through the first flow channel 214*a* and the second flow channel 214*b*, respectively, the protrusion 213 allows the operation fluids to entirely move on each of the flow channels 214*a* and 214*b*, thereby increasing a heat exchange area and improving efficiency.

Here, the operation fluids may be a refrigerant of a high temperature and a high pressure discharged from the condenser 20 to pass through each first flow channel 214*a* through the first inflow hole 216*a* as a first refrigerant, and a refrigerant of a low temperature and a low pressure discharged from the evaporator 40 to pass through each second flow channel 214*b* through the second inflow hole 216*b* as a second refrigerant.

In a second exemplary embodiment, two of each of the flow channel, the inflow hole, and the exhaust hole that are formed in the heat exchange unit 210 are provided, but the present disclosure is not limited thereto, and the number of each of the flow channel, the inflow hole, and the exhaust hole may be changed and applied according to the number of injected operation fluids.

For example, when the operation fluids further include a coolant, by increasing the number of the plates 212, a new flow channel is formed and an inflow hole and an exhaust hole that are connected to the new flow channel may be also formed.

The noise reducer 250 is integrally formed with the heat exchange unit 210 at the heat exchange unit 210 and reduces noise and vibration occurring when the second refrigerant is injected through the second inflow hole 216*b* and moves. Here, the noise reducer 250 includes a noise reduction plate 252, a resonance hole 255, and a closing and sealing plate 256.

The noise reduction plate 252 may be at least one piece layered at one surface of the heat exchange unit 210. The noise reduction plate 252 has a protruding end 253 protruding toward the connection block 222 which is the opposite side of the heat exchange unit 210. The noise reduction plate 252 may further include a connection hole 254 connected to the second exhaust hole 218*b*.

The protruding end 253 is connected to the connection hole 254 at one side thereof in the resonance hole 255. The closing and sealing plate 256 is mounted with the protruding end 253 at the noise reduction plate 252 to form a space S which communicates with the resonance hole 255 between the closing and sealing plate 256 and the noise reduction plate 252.

That is, the space S is formed by the closing and sealing plate 256 that is mounted to the protrusion end 253 at the other surface of the noise reduction plate 252. Here, the space S may block the connection to the first inflow hole 216*a* and the first flow channel 214*a* to inject only the second refrigerant discharged through the second exhaust hole 218*b*.

In the noise reducer 250 according to the second exemplary embodiment, when the second refrigerant passing through the second flow channel 214*b* through the second exhaust hole 218*b* is discharged, the second refrigerant is injected into the space S through the resonance hole 255.

Therefore, while the second refrigerant is injected into the space S through the resonance hole 255, it generates an inverse frequency of noise and vibration occurring when the second refrigerant moves.

Such an inverse frequency offsets a standing wave by noise and vibration generated in the second refrigerant while being discharged through the second exhaust hole 218*b*, thus, reducing the vibration and noise of the second refrigerant.

That is, the noise reducer 250 of the second exemplary embodiment performs a function of a resonance type muffler. The standing wave generated by noise and vibration when the second refrigerant moves in a closed and sealed space that is connected through a small inlet or hole can be reduced. The noise and vibration, which are inverted with respect to the standing wave, occurs, and the inversed wave offsets noise of a specific frequency band (generally a high frequency area) of the standing wave, and thus, reducing the noise and vibration.

In the second exemplary embodiment, the noise reducer 250 performs a function of a resonance type muffler using a Helmholtz resonator in which inverse noise and vibration occurs while passing through a closed and sealed space that is connected through a small inlet or hole.

Since the noise reducer 250 is integrally formed in the heat exchange unit 210 according to the present disclosure, a separate muffler or a long air conditioner pipe in order to reduce the noise and vibration is not necessary.

Hereinafter, an operation of the vehicle heat exchanger 200 according to a second exemplary embodiment of the present inventive concept will be described in detail.

Figure 11:
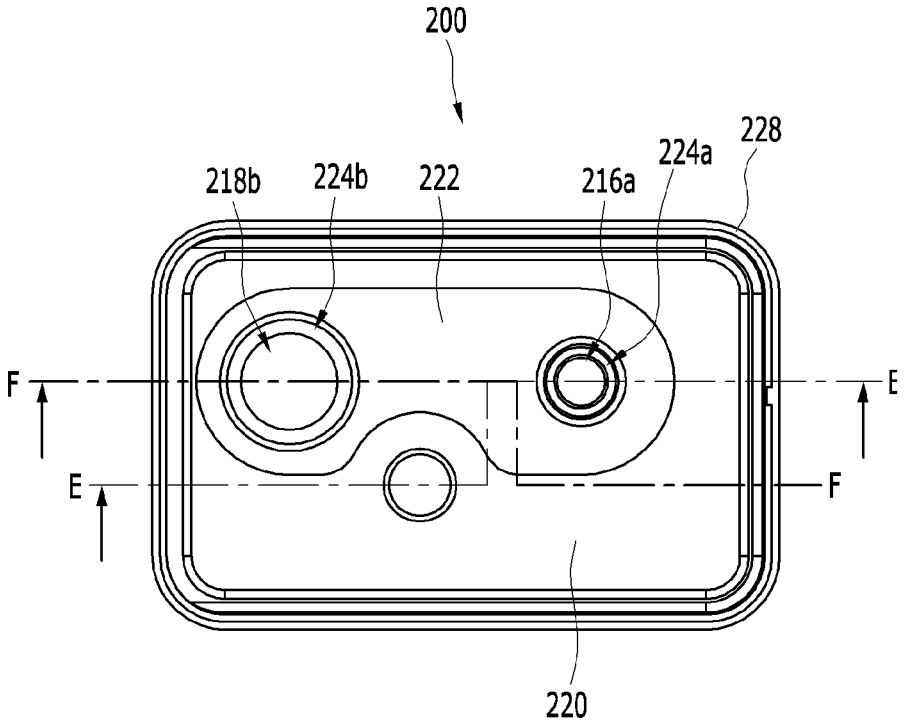
FIG. 11 is a top plan view illustrating the heat exchanger for a vehicle according to the second exemplary embodiment of the present inventive concept.
Figure 12:
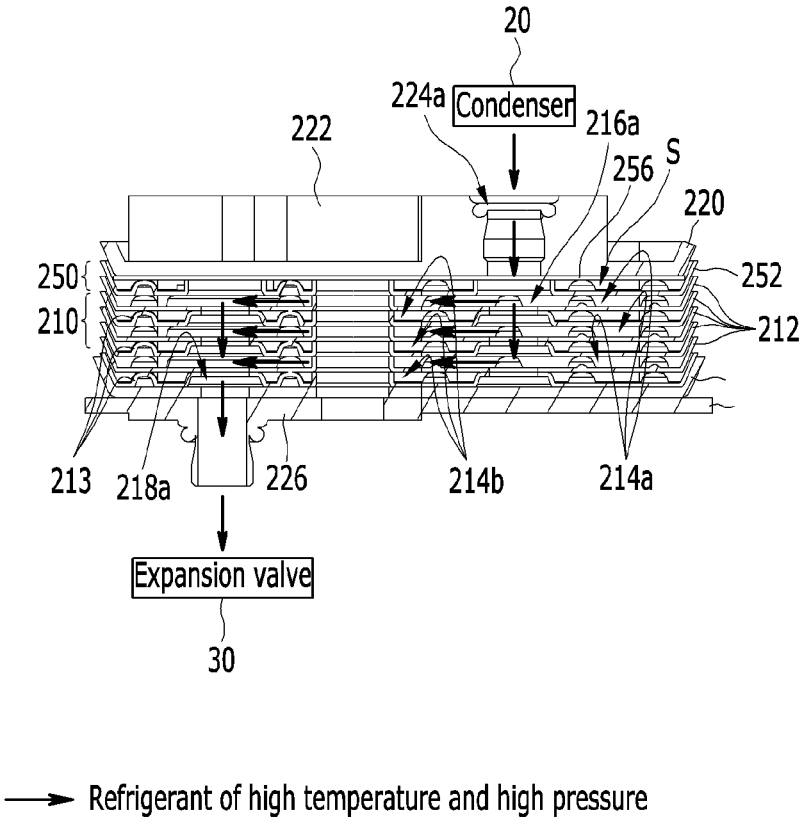
FIG. 12 is a cross-sectional view taken along the line E-E of FIG. 11 illustrating a moving state of a refrigerant that is discharged from a condenser.
Figure 13:
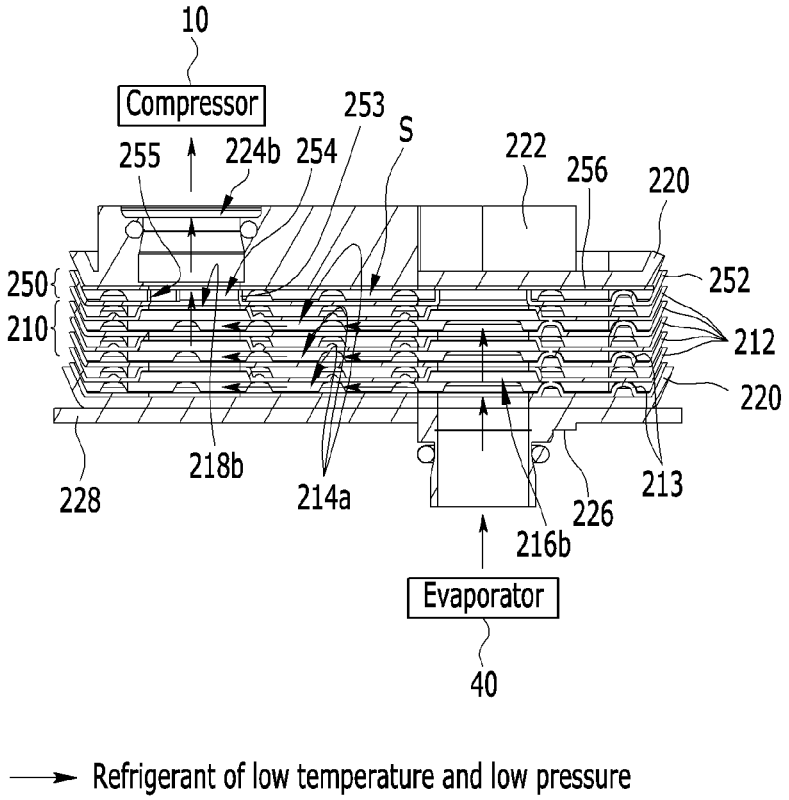
FIG. 13 is a cross-sectional view taken along the line F-F of FIG. 11 illustrating a moving state of a refrigerant that is discharged from an evaporator.

FIG. 11 is a top plan view illustrating a heat exchanger for a vehicle according to a second exemplary embodiment of the present inventive concept, FIG. 12 is a cross-sectional view taken along the line E-E of FIG. 11 illustrating a moving state of a refrigerant that is discharged from a condenser, and FIG. 13 is a cross-sectional view taken along the line F-F of FIG. 11 illustrating a moving state of a refrigerant that is discharged from an evaporator.

First, as shown in FIG. 12, the first refrigerant that is condensed in the condenser 20 is injected through the first penetration hole 224*a* formed in the connection block 222 of the heat exchanger 200.

The first refrigerant is then injected into the first inflow hole 216*a* by penetrating the noise reducer 250, and is discharged to the expansion valve 30 through the first exhaust hole 218*a* by passing through each first flow channel 214*a*.

Here, as the space S, which is formed in the noise reduction unit 250, blocks the first flow channel 214*a* and the first inflow hole 216*a*, the first refrigerant is supercooled by exchanging heat with the second refrigerant passing through each second flow channel 214*b* and through each first flow channel 214*a* while flowing into the space S is prevented.

As shown in FIG. 13, the second refrigerant, which is discharged from the evaporator 40, is injected into the second inflow hole 216*a* to exchange the heat with the first refrigerant that is injected into the second inflow hole 214*b* to pass through each first flow channel 214*a* while passing through each second flow channel 214*b* and is injected into the noise reducer 250 through the second exhaust hole 216*b*.

Here, the second refrigerant o generates inverse noise and vibration of a standing wave while passing through the space S that is connected through the resonance hole 255 of the noise reducer 250.

Such an inverse wave offsets noise of a specific frequency band (generally a high frequency area) of the standing wave that is generated when the second refrigerant moves. Thus, the second refrigerant reduces the noise and vibration occurring while being discharging from the second exhaust hole 218*b*.

Since the vehicle heat exchanger 200 according to the second exemplary embodiment of the present inventive concept is directly mounted in the expansion valve 30 and integrally forms the noise reducer 250 together with the heat exchange unit 210, the noise and vibration of the second refrigerant is reduced.

Further, the heat exchange unit 210 supercools the first refrigerant through the heat exchange with the second refrigerant, and thus a non-condensable refrigerant that is included in the first refrigerant o is injected into the expansion valve 30 through the heat exchange.

The heat exchanger 200 additionally lowers a temperature at the inlet side of the evaporator 40 and makes a large enthalpy difference of the evaporator 40, thereby maximizing a COP.

The heat exchanger 200 according to the second exemplary embodiment further prevents efficiency of the air conditioning system from being deteriorated by a non-condensable gas refrigerant, thereby increasing expansion efficiency in the expansion valve 30.

Figure 14:
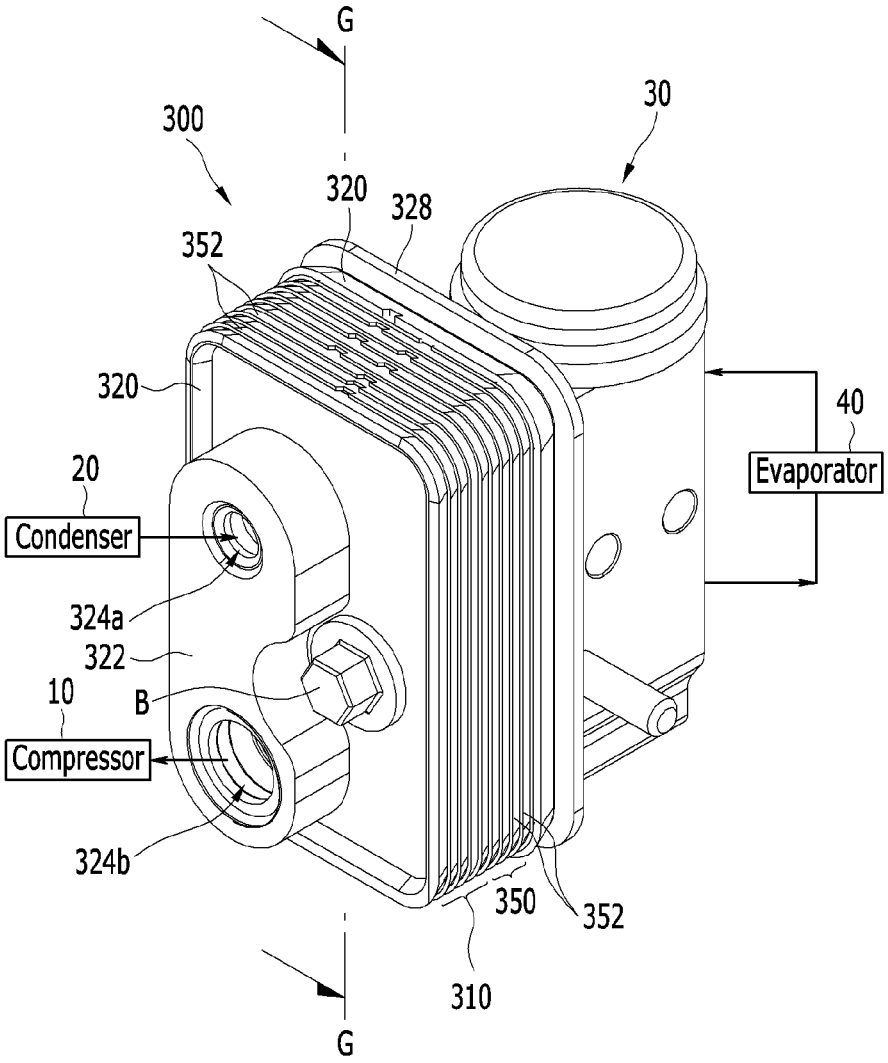
FIG. 14 is a perspective view illustrating a heat exchanger for a vehicle according to a third exemplary embodiment of the present inventive concept.
Figure 15:
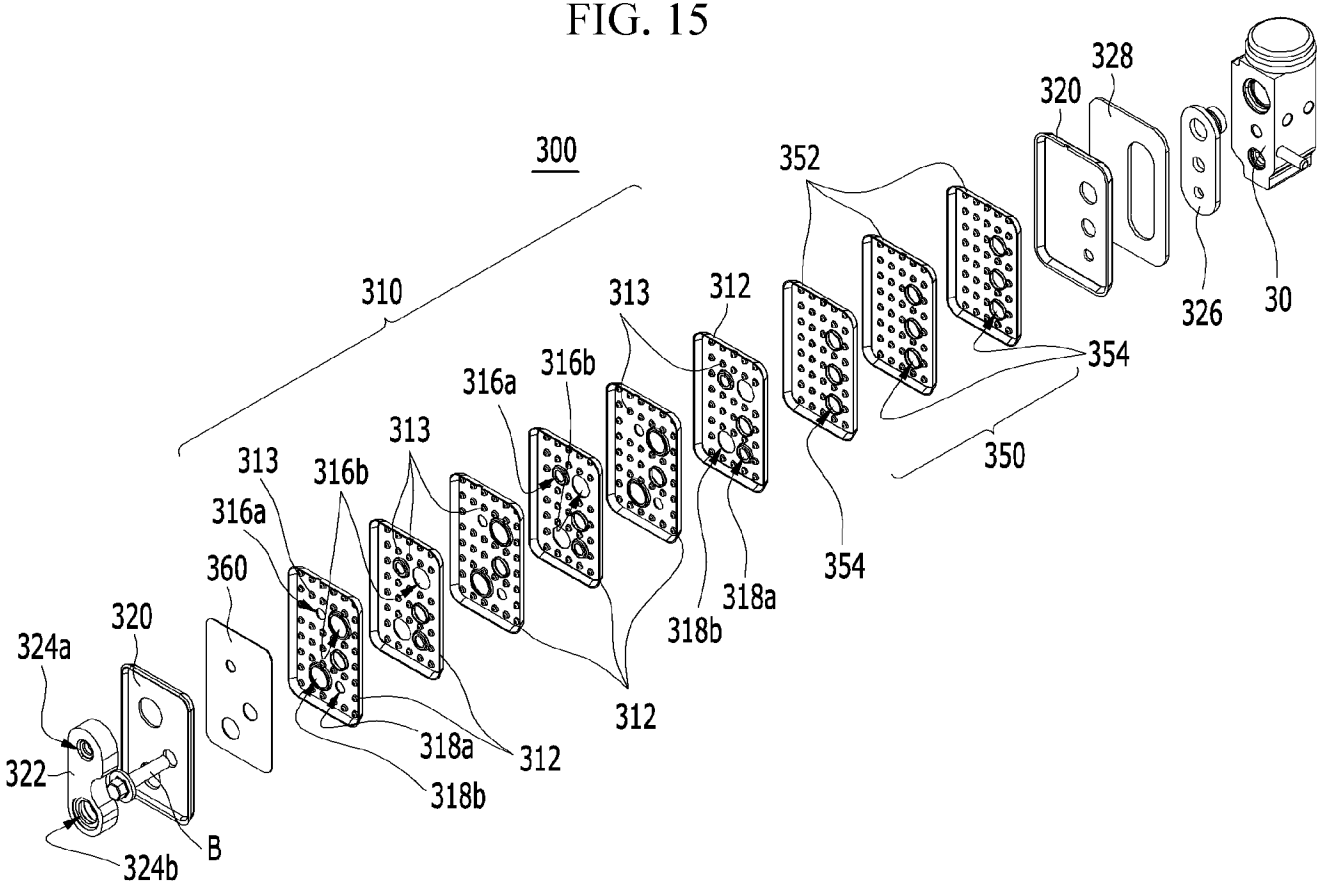
FIG. 15 is an exploded perspective view illustrating the heat exchanger for a vehicle according to the third exemplary embodiment of the present inventive concept.
Figure 16:
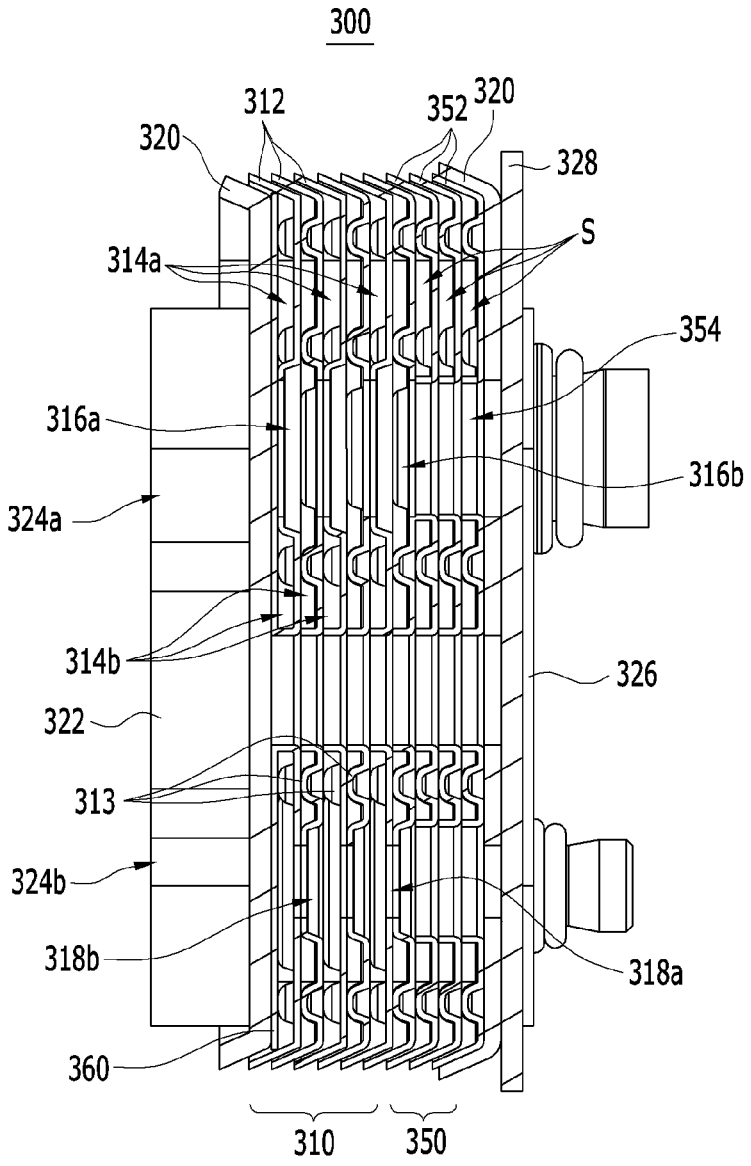
FIG. 16 is a cross-sectional view taken along the line G-G of FIG. 14.

FIGS. 14 and 15 are a perspective view and an exploded perspective view illustrating a heat exchanger for a vehicle according to a third exemplary embodiment of the present inventive concept, respectively, and FIG. 16 is a cross-sectional view taken along the line G-G of FIG. 14.

A vehicle heat exchanger 300 according to a third exemplary embodiment of the present inventive concept is directly mounted in an expansion valve 30 between a condenser 20 and the expansion valve 30 in an air conditioning system. The air conditioning system includes a compressor 10 that compresses a refrigerant, the condenser 20 that condenses a refrigerant, and the expansion valve 30 that expands the condensed refrigerant. An evaporator 40 evaporates the expanded refrigerant through heat exchange with air, and exchanges heat of the refrigerant, which is an operation fluid injected into the vehicle heat exchanger 300.

As shown in FIGS. 14 to 16, the vehicle heat exchanger 300 according to a third exemplary embodiment includes a heat exchange unit 310, first and second inflow holes 316*a* and 316*b*, first and second exhaust holes 318*a* and 318*b*, an expansion valve 30, and a noise reducer 350.

First, in the heat exchange unit 310, a plurality of plates 312 are layered to alternately form a first flow channel 314*a* and a second flow channel 314*b* therein, and the heat exchange unit 310 exchanges heat of operation fluids passing through each of the first and second flow channels 314*a* and 314*b*.

The heat exchange unit 310 may have a plate shape in which the plurality of plates 312 are layered.

In the third exemplary embodiment, the first inflow hole 316*a* and the second inflow hole 316*b* are formed at separated locations at both surfaces of the heat exchange unit 310, and are connected to the first flow channel 314*a* and the second flow channel 314*b*, respectively.

The first exhaust hole 318*a* and the second exhaust hole 318*b* are formed at separated locations in a diagonal direction of the first and second inflow holes 316*a* and 316*b* at one surface and the other surface of the heat exchange unit 310, and are connected to the first flow channel 314*a* and the second flow channel 314*b*, respectively.

Here, the first inflow hole 316*a* may be formed at one surface of the heat exchange unit 310, and the first exhaust hole 318*a* may be formed at another surface of the heat exchange unit 310 in a diagonal direction of the first inflow hole 316*a*.

Further, the second inflow hole 316*b* may be formed at the other surface of the heat exchange unit 310, and the second exhaust hole 318*b* may be formed at the one surface of the heat exchange unit 310 in a diagonal direction of the second inflow hole 316*b*.

Accordingly, by allowing the operation fluids that pass through the first and second flow channels 314*a* and 314*b*, to counterflow, the heat exchange unit 310 may exchange heat.

Here, a cover plate 320 may be mounted at each of the heat exchange unit 310 and the noise reducer 350.

Further, in the heat exchange unit 310, a closing and sealing plate 360 that prevents a refrigerant from being leaked between the cover plate 320 and the plurality of plates 312 may be mounted.

The cover plate 320, which is located at an opposite side of the expansion valve 30, may have a connection block 322 having first and second penetration holes 324*a* and 324*b* communicating with the first inflow hole 316*a* and the second exhaust hole 318*b*, respectively, mounted thereto.

The connection block 322 enables pipes to be easily connected for connecting the compressor 10 or the evaporator 40 to the heat exchanger 300, thereby improving assembling efficiency.

The plate 312 having the heat exchange unit 310 may include at least one protrusion 313 protruding at an inner side of the first and second flow channels 314*a* and 314*b*.

The at least one protrusion 313 controls movement of the operation fluids to uniformly flow over the first flow channel 314*a* and the second flow channel 314*b* entirely by detouring the operation fluids that pass through each of the first flow channel 314*a* and the second flow channel 314*b*.

That is, when the operation fluids pass through the first flow channel 314*a* and the second flow channel 314*b*, the at least one protrusion 313 enable the operation fluids to entirely move on each of the flow channels 314*a* and 314*b*, thereby increasing a heat exchange area and improving efficiency.

Here, the operation fluids may be a refrigerant of a high temperature and a high pressure discharged from the condenser 20 to pass through each first flow channel 314*a* through the first inflow hole 316*a* as a first refrigerant, and a refrigerant of a low temperature and a low pressure discharged from the evaporator 40 to pass through each second flow channel 314*b* through the second inflow hole 316*b* as a second refrigerant.

In the third exemplary embodiment, two of each of a flow channel, an inflow hole, and an exhaust hole that are formed in the heat exchange unit 310 are disclosed, but the present disclosure is not limited thereto, and the number of each of a flow channel, an inflow hole, and an exhaust hole may be changed and applied according to the number of injected operation fluids.

For example, when the operation fluids further include a coolant, by increasing the layered number of the plates 312, a new flow channel is formed and an inflow hole and an exhaust hole that are connected to the new flow channel may also be formed.

In the third exemplary embodiment, the expansion valve 30 is integrally mounted with the heat exchange unit 310 at one surface of the heat exchange unit 310.

The noise reducer 350 is integrally formed with the heat exchange unit 310 at one surface of the heat exchange unit 310 between the heat exchange unit 310 and the expansion valve 30, and reduces noise and vibration occurring when the second refrigerant moves.

Here, the expansion valve 30 is connected to the heat exchange unit 310 through a connection flange 326 that is mounted in the noise reduction unit 350.

Further, the expansion valve 30 may be integrally fixed to the heat exchange unit 310 with the noise reduction unit 350 interposed therebetween through a fixing bolt B that is engaged by penetrating the heat exchange unit 310 and the noise reducer 350 from the other surface of the heat exchange unit 310. The connection flange 326 may be mounted in the noise reducer 350 through a fixed plate 328.

Accordingly, the heat exchange unit 310 is mounted in the expansion valve 30 through the connection flange 326 with the noise reducer 350 interposed therebetween.

In the third exemplary embodiment, the noise reducer 350 includes a noise reduction plate 352 and a connection hole 354.

First, the noise reduction plate 352 may be formed with at least two pieces, and in a third exemplary embodiment of the present invention, the noise reduction plate 352 may be formed with three pieces.

Such a noise reduction plate 352 is layered at one surface of the heat exchange unit 310 between the heat exchange unit 310 and the expansion valve 30 to form at least one space S therein.

The connection hole 354 is formed in the noise reduction plate 352 to correspond to the second inflow hole 316*b*, and enables the operation fluids to be injected into the second inflow hole 316*b* to pass through the space S and injects the operation fluids into the second flow channel 314*b* through the second inflow hole 316*b*.

Here, the space S may block the connection to the first flow channel 314*a*, the first inflow hole 316*a*, and the first exhaust hole 318*a* so that the second refrigerant, that is injected through the connection hole 354, passes through the spaces S and is injected through the second inflow hole 316*b* to pass through the second flow channel 314*b*.

The noise reducer 350 according to the present disclosure performs a function of an expansion muffler that reflects noise and vibration occurring while the second refrigerant moves through the connection hole 354 having a smaller cross-sectional area than that of the space S using a difference in the cross-sectional areas.

Since the noise reducer 350 is integrally formed in the heat exchange unit 310 between the expansion valve 30 and the heat exchange unit 310, it may be unnecessary to mount a separate muffler or to set a long air conditioner pipe that is applied for reducing the noise and vibration.

In the vehicle heat exchanger 300 according to the third exemplary embodiment, when the first refrigerant, that is condensed in the condenser 20, is injected through the first penetration hole 324*a* formed in the connection block 322 of the heat exchanger 300, the first refrigerant is discharged to the first exhaust hole 318*a* by passing through the first flow channel 314*a* through the first inflow hole 316*a*.

The second refrigerant, which is discharged from the evaporator 40, is injected into the connection hole 354 of the noise reducer 350 to pass through each space S. That is, the second refrigerant moves from the connection hole 354 having a relatively small cross-sectional area to each space S having a large cross-sectional area.

Here, as each space S and the cross-sectional area of the connection hole 354 perform the function of the expansion muffler that reflects the noise and vibration using the cross-sectional area difference, the noise and vibration that are generated in the second refrigerant is offset and reduced.

Thereafter, the second refrigerant is injected into the second inflow hole 316*b* to exchange the heat with the first refrigerant passing through each first flow channel 314*a* while passing through the second flow channel 314*b*, and is discharged to the compressor 10 through the second exhaust hole 318*b*.

The first refrigerant, that is injected into the heat exchange unit 310 through the first inflow hole 316*a*, penetrates the noise reducer 350 in a supercooled state by exchanging the heat with the second refrigerant that passes through the second flow channel 314*b* while passing through the first flow channel 314*a*, and is discharged to the expansion valve 30.

Since the vehicle heat exchanger 300 according to the third exemplary embodiment is directly mounted in the expansion valve 30 and integrally forms the noise reducer 350 together with the heat exchange unit 310, the noise and vibration is reduced.

Further, the heat exchange unit 310 supercools the first refrigerant through the heat exchange with the second refrigerant, and thus a noncondensable refrigerant that is included in the first refrigerant is injected into the expansion valve 30 in a condensed state through the heat exchange. Accordingly, the heat exchanger 300 additionally decreases a temperature at the inlet side of the evaporator 40 and makes a large enthalpy difference of the evaporator 40, thereby maximizing a COP.

The heat exchanger 300 according to the third exemplary embodiment prevents efficiency of the air conditioning system from being deteriorated by a non-condensable gas refrigerant, thereby increasing expansion efficiency in the expansion valve 30.

Figure 17:
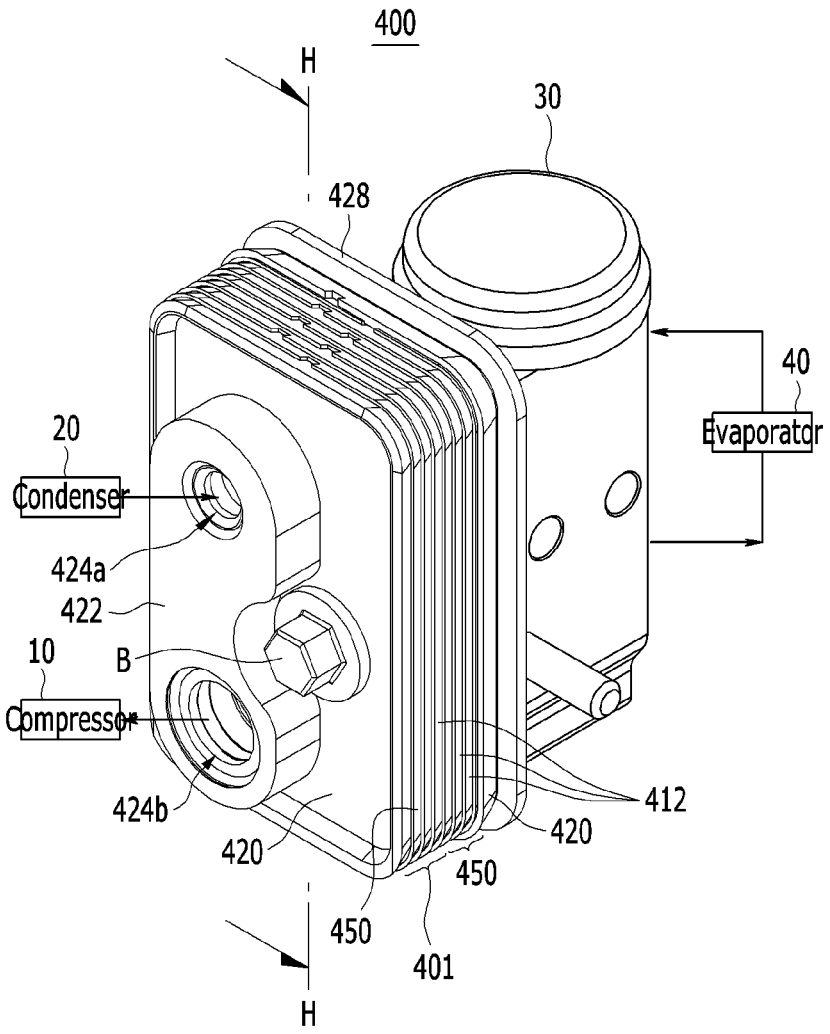
FIG. 17 is a perspective view illustrating a heat exchanger for a vehicle according to a fourth exemplary embodiment of the present inventive concept.
Figure 18:
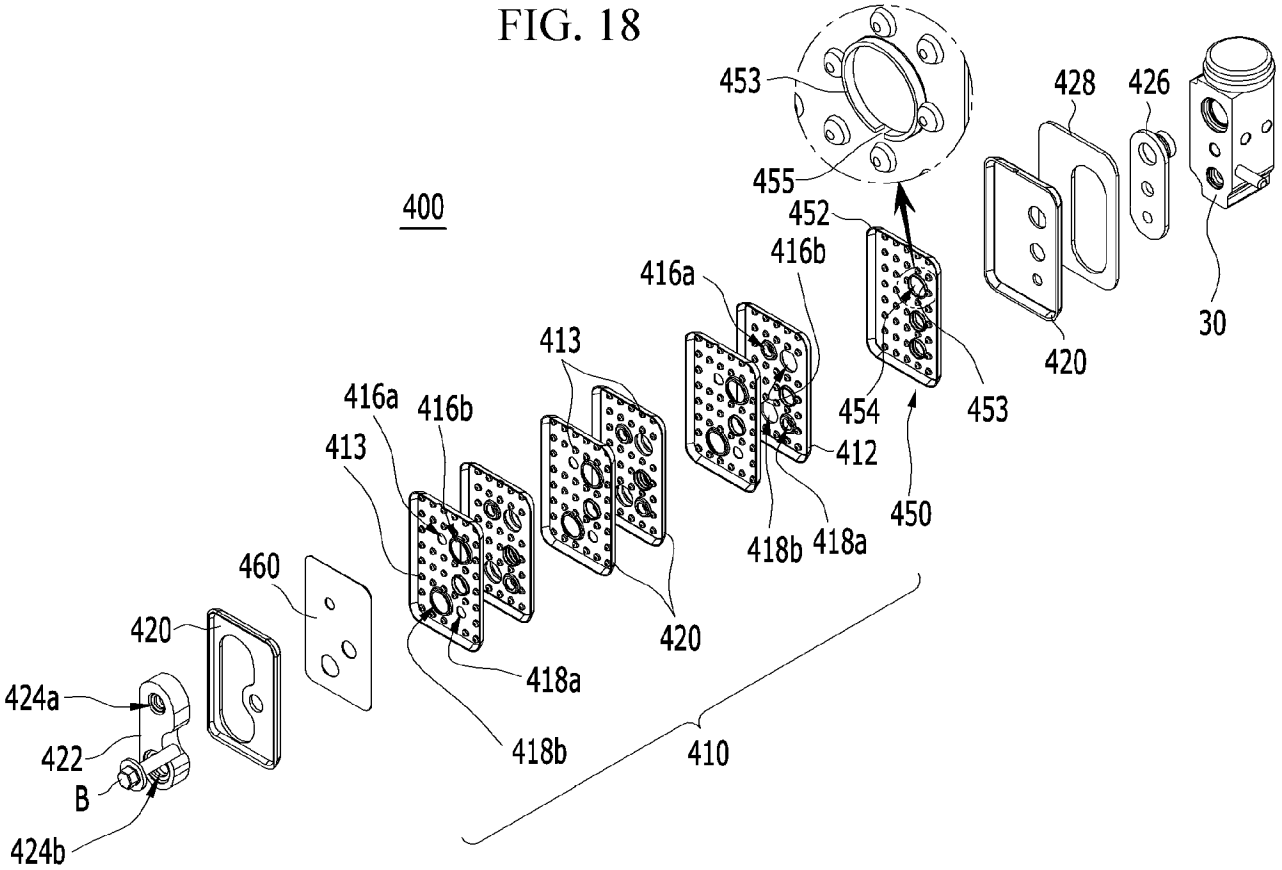
FIG. 18 is an exploded perspective view illustrating the heat exchanger for a vehicle according to the fourth exemplary embodiment of the present inventive concept.
Figure 19:
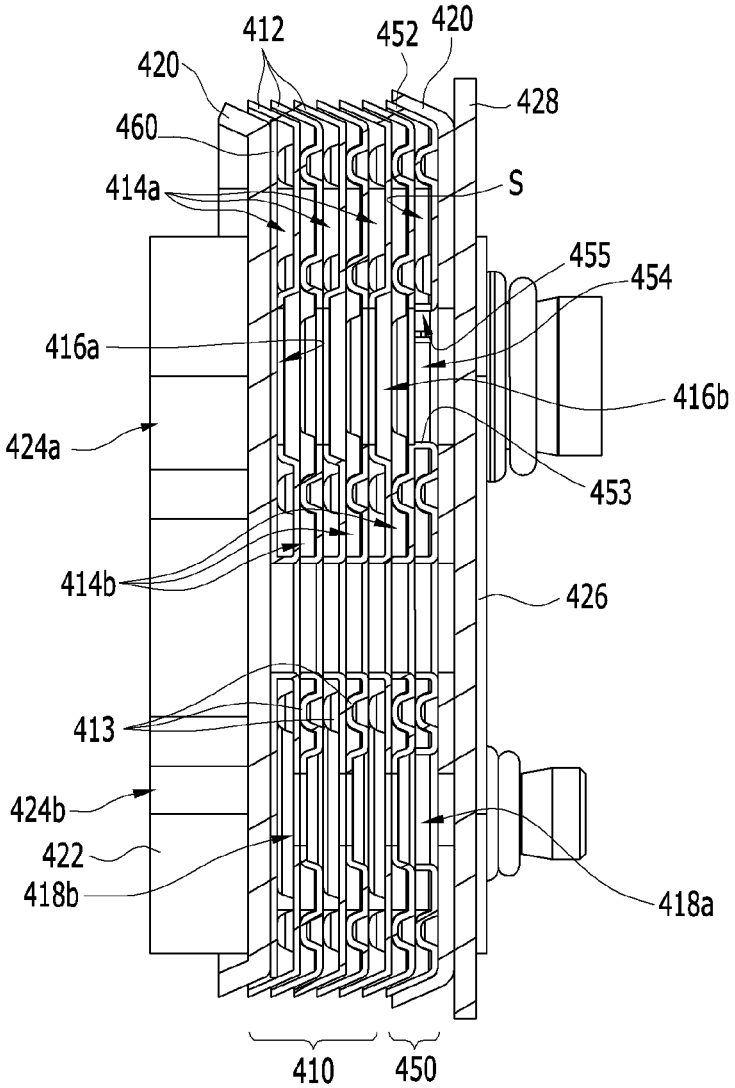
FIG. 19 is a cross-sectional view taken along the line H-H of FIG. 17.

FIGS. 17 and 18 are a perspective view and an exploded perspective view illustrating a heat exchanger for a vehicle according to a fourth exemplary embodiment of the present inventive concept, respectively, and FIG. 19 is a cross-sectional view taken along the line H-H of FIG. 17.

A vehicle heat exchanger 400 according to a fourth exemplary embodiment of the present inventive concept is directly mounted in an expansion valve 30 between a condenser 20 and the expansion valve 30 in an air conditioning system. The air conditioning system includes a compressor 10 that compresses a refrigerant, the condenser 20 that condenses a refrigerant, and the expansion valve 30 that expands the condensed refrigerant. An evaporator 40 evaporates the expanded refrigerant through heat exchange with air, and exchanges heat of a refrigerant, which is an operation fluid that is injected into the vehicle heat exchanger 400.

As shown in FIGS. 17 to 19, the vehicle heat exchanger 400 according to the fourth exemplary embodiment includes a heat exchange unit 410, first and second inflow holes 416*a* and 416*b*, first and second exhaust holes 418*a* and 418*b*, an expansion valve 30, and a noise reducer 450.

The heat exchange unit 410 has a plurality of plates 412 layered to alternately form a first flow channel 414*a* and a second flow channel 414*b* therein and exchanges heat of operation fluids passing through each of the first and second flow channels 414*a* and 414*b*.

The heat exchange unit 410 having such a configuration may be formed in a plate shape in which the plurality of plates 412 are layered.

In the fourth exemplary embodiment, the first inflow hole 416*a* and the second inflow hole 416*b* are formed at separated locations at both surfaces of the heat exchange unit 410 and connected to the first flow channel 414*a* and the second flow channel 414*b*, respectively.

The first exhaust hole 418*a* and the second exhaust hole 418*b* are formed at separated locations in a diagonal direction of the first and second inflow holes 416*a* and 416*b* at both surfaces of the heat exchange unit 410 and connected to the first flow channel 414*a* and the second flow channel 414*b*, respectively.

That is, the first inflow hole 416*a* may be formed at one surface of the heat exchange unit 410, and the first exhaust hole 418*a* may be formed at another surface of the heat exchange unit 410 in a diagonal direction of the first inflow hole 416*a*. The second inflow hole 416*b* may be formed at another surface of the heat exchange unit 410, and the second exhaust hole 418*b* may be formed at the one surface of the heat exchange unit 410 at separated locations in a diagonal direction of the second inflow hole 416*b*.

Accordingly, as operation fluids pass through the first and second flow channels 414*a* and 414*b* through the first and second inflow holes 416*a* and 416*b*, respectively, to counterflow, the heat exchange unit 410 may exchange heat.

Further, a cover plate 420 may be mounted at each of the heat exchange unit 410 and the noise reducer 450.

The heat exchange unit 410 may further include a closing and sealing plate 460 that prevents a refrigerant from being leaked between the cover plate 420 and the plate 412.

In the cover plate 420 may include a connection block 422 having first and second penetration holes 424*a* and 424*b* that communicate with the first inflow hole 416*a* and the second exhaust hole 418*b*, respectively.

The connection block 422 enables pipes to be easily connected for connecting the compressor 10 or the evaporator 40 to the heat exchanger 400, thereby improving assembling efficiency.

The plates 412 may include at least one protrusion 413 protruding from the first and second flow channels 414*a* and 414*b*.

The at least one protrusion 413 controls movement of the operation fluids to uniformly flow over the first flow channel 414*a* and the second flow channel 414*b* entirely by detouring the operation fluids that pass through each of the first flow channel 414*a* and the second flow channel 414*b*.

That is, when operation fluids that are injected into each of the first inflow hole 416*a* and the second inflow hole 416*b* pass through the first flow channel 414*a* and the second flow channel 414*b*, the protrusions 413 enable the operation fluids to entirely move on each of the flow channels 414*a* and 414*b*, thereby increasing a heat exchange area and improving efficiency.

The operation fluids may be a refrigerant of a high temperature and a high pressure that is discharged from the condenser 20 to pass through each first flow channel 414*a* through the first inflow hole 416*a* as a first refrigerant, and a refrigerant of a low temperature and a low pressure that is discharged from the evaporator 40 to pass through each second flow channel 414*b* through the second inflow hole 416*b* as a second refrigerant.

In the fourth exemplary embodiment, there are two of each of a flow channel, an inflow hole, and an exhaust hole that are formed in the heat exchange unit 410, but the present disclosure is not limited thereto, and the number of each of a flow channel, an inflow hole, and an exhaust hole may be changed and applied according to the number of the injected operation fluids.

For example, when the operation fluids further include a coolant, and a new flow channel is formed and an inflow hole and an exhaust hole that are connected to the new flow channel may be newly formed by increasing the layered number of the plates 412.

In the present exemplary embodiment, the expansion valve 30 is integrally mounted with the heat exchange unit 410 at one surface of the heat exchange unit 410.

The noise reducer 450 is integrally formed with the heat exchange unit 410 at one surface of the heat exchange unit 410 between the heat exchange unit 410 and the expansion valve 30, and reduces noise and vibration occurring when the second refrigerant that is injected through the second inflow hole 416*b* moves.

The expansion valve 30 is connected to the heat exchange unit 410 through a connection flange 426 that is mounted in the noise reducer 450. Further, the expansion valve 30 may be integrally fixed to the heat exchange unit 410 with the noise reducer 450 interposed therebetween through a fixing bolt B that is engaged by penetrating the heat exchange unit 410 and the noise reducer 450 from the other surface of the heat exchange unit 410.

The connection flange 426 may be mounted in the noise reducer 450 through a fixed plate 428. Accordingly, the heat exchange unit 410 is mounted in the expansion valve 30 through the connection flange 426 with the noise reducer 450 interposed therebetween to be formed in an integral form.

In the fourth exemplary embodiment, the noise reducer 450 includes a noise reduction plate 452 and a resonance hole 455.

The noise reduction plate 452 may be formed with at least one piece, and in the fourth exemplary embodiment, the noise reduction plate 452 may be one piece. The noise reduction plate 452 is layered at one surface of the heat exchange unit 410 between the heat exchange unit 410 and the expansion valve 30 to form one space S therein.

Here, the noise reduction plate 452 protrudes to one surface of the heat exchange unit 410 to have a protruding end 453 contacting with the plate 412 of the heat exchange unit 410, and has a connection hole 454 that is connected to the second inflow hole 416*b*. That is, in the connection hole 454, the protruding end 453 integrally protrudes from an interior circumferential surface.

In the resonance hole 455, one side of the protruding end 453 is open to be connected to the connection hole 454.

The space S may block the connection to the first flow channel 414*a*, the first inflow hole 416*a*, and the first exhaust hole 418*a* so as to inject only the second refrigerant injected into the second inflow hole 416*b* through the connection hole 454 to pass through the second flow channel 414*b* through the resonance hole 455.

In the noise reducer 450 of the fourth exemplary embodiment, when the second refrigerant of is injected through the connection hole 454, it is injected into the space S that is formed between the heat exchange unit 410 and the noise reduction plate 452 through the resonance hole 455.

Accordingly, the second refrigerant generates an inverse frequency of noise and vibration frequency occurring when it moves while being injected into the space S through the resonance hole 455.

Such an inverse frequency offsets a standing wave by noise and vibration generated in the second refrigerant that is injected through the connection hole 454, and thus, the vibration and noise of the second refrigerant is reduced.

The noise reducer 450 performs a function of a resonance type muffler, and while the standing wave is injected into a closed and sealed space that is connected through a small inlet or hole on a moving path, noise and vibration that are inverted with respect to the standing wave occurs, and the inverse wave offsets noise of a specific frequency band (generally a high frequency area) of the standing wave, thus reducing the noise and vibration occurring when the second refrigerant moves.

In the fourth exemplary embodiment, the noise reducer 450 performs the function of the resonance type muffler using a Helmholtz resonator in which inverse noise and vibration occurs while passing through the closed and sealed space connected through the small inlet or hole.

Since the noise reducer 450 is integrally formed in the heat exchange unit 410 between the expansion valve 30 and the heat exchange unit 410, a separate muffler or a long air conditioner pipe for reducing the noise and vibration is not necessary.

In the vehicle heat exchanger 400 according to the fourth exemplary embodiment, when the first refrigerant condensed in the condenser 20 is injected through the first penetration hole 424*a* which is formed in the connection block 422 of the heat exchanger 400, the first refrigerant is discharged to the first exhaust hole 418*a* and is injected into the expansion valve 30 by passing through the first flow channel 414*a* through the first inflow hole 416*a*.

The second refrigerant discharged from the evaporator 40 is injected into the connection hole 454 of the noise reducer 450, reduces noise while passing through each space S through the resonance hole 455, and is injected into the heat exchange unit 410 through the second inflow hole 416*b*.

Accordingly, the first refrigerant that passes through the first flow channel 414*a* exchanges heat with the second refrigerant that passes through the second flow channel 414*b*.

When the second refrigerant passes through the space S connected through the resonance hole 455 while being injected through the connection hole 454 of the noise reducer 450, inverse noise and vibration of the standing wave occurs.

Such an inverse wave offsets noise of the standing wave which is generated when the second refrigerant moves, and thus, the second refrigerant reduces the noise and vibration while being injected from the connection hole 454.

Since the vehicle heat exchanger 400 according to the fourth exemplary embodiment is directly mounted in the expansion valve 30 and integrally forms the noise reducer 450 together with the heat exchange unit 410, the noise and vibration is reduced.

Further, since the heat exchange unit 410 supercools the first refrigerant by the heat exchange with the second refrigerant, a noncondensable refrigerant included in the first refrigerant is injected into the expansion valve 30 in a condensed state through the heat exchange.

Accordingly, the heat exchanger 400 additionally reduces a temperature of a refrigerant of the inlet side of the evaporator 40 and makes a large enthalpy difference of the evaporator 40, thereby maximizing a COP.

Further, the heat exchanger 400 according to the fourth exemplary embodiment prevents efficiency of the air conditioning system from being deteriorated by a non-condensable gas refrigerant, thereby increasing expansion efficiency in the expansion valve 30.

When describing the vehicle heat exchangers 100, 200, 300, and 400 according to first, second, third, and fourth exemplary embodiments of the present disclosure, it is described that the heat exchange units 110, 210, 310, and 410 or the noise reduction units 150, 250, 350, and 450 that are integrally formed in the heat exchange units 110, 210, 310, and 410 are integrally mounted in the expansion valve 30 through the fixing bolt B. However, the present disclosure is not limited thereto, and upon mounting the heat exchangers 100, 200, 300, and 400 in a vehicle, when connecting the heat exchange units 110, 210, 310, and 410 or the noise reducers 150, 250, 350, and 450 to the expansion valve 30 in consideration of whether interference with other components within an engine compartment and an internal space occurs, the heat exchange units 110, 210, 310, and 410 or the noise reducers 150, 250, 350, and 450 may be connected to the expansion valve 30 through a connection pipe or a flange block having a flow channel at the inside.

Therefore, when applying the vehicle heat exchangers 100, 200, 300, and 400 according to the first, second, third, and fourth exemplary embodiments of the present inventive concept, the vehicle heat exchangers 100, 200, 300, and 400 are integrally mounted in the expansion valve 30 to supercool the first refrigerant that is supplied from the condenser 20 through heat exchange with the second refrigerant that is supplied from the evaporator 40 to a compressor, thereby improving air conditioning performance of an air conditioning system and simplifying refrigerant flow, and thus occurrence of pressure drop within a condenser inlet and outlet pipe can be reduced.

Further, by supercooling and supplying the refrigerant to the evaporator 40, a refrigerant temperature of the inlet side of the evaporator 40 additionally decreases, and an enthalpy difference of the evaporator 40 is largely formed. Thus, a COP, which is a coefficient of an air conditioning ability to consume power of the compressor 10, increases, and thus, an air conditioning performance and air conditioning efficiency of an entire air conditioning system can be improved compared with a conventional case.

By reducing the noise and vibration from occurring when the second refrigerant moves by integrally forming the noise reducers 150, 250, 350, and 450, the noise and vibration is prevented from being transferred to a vehicle interior, and an entire NVH performance of the vehicle is improved such that driving impression and entire marketability of the vehicle can be improved.

By forming the heat exchangers 100, 200, 300, and 400 integrally in the expansion valve 30 and by removing a separately mounted muffler, constituent elements can be simply formed, thus reducing production cost.

A layout within a small engine compartment is simplified by reducing a length of an air conditioner pipe, space use can be improved.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A heat exchanger for a vehicle comprising:

a heat exchange unit including a plurality of plates layered to alternately form a first flow channel and a second flow channel therein to exchange heat of operation fluids passing through each of the first and second flow channels, the heat exchange unit having one surface connected to an expansion valve;

first and second inflow holes formed separately at both surfaces of the heat exchange unit and connected to the first flow channel and the second flow channel, respectively;

first and second exhaust holes formed separately in a diagonal direction of the first and second inflow holes at both surfaces of the heat exchange unit and connected to the first flow channel and the second flow channel, respectively; and a noise reducer integrally connected to another surface of the heat exchange unit, the noise reducer reducing noise and vibration occurring when an operation fluid that is injected through the second inflow hole moves; and wherein the noise reducer comprises:

at least two noise reduction plates layered at the other surface of the heat exchange unit, the at least two noise reduction plates forming at least one space in the noise reducer and having a connection hole which communicates with the second exhaust hole; and a closing and sealing plate mounted to an outer side of the at least two noise reduction plates to form a space between the closing and sealing plate and the outer side of the at least two noise reduction plates, wherein the heat exchange unit and the noise reducer have a cover plate mounted at the one surface of the heat exchange unit and the another surface of the noise reducer, and the cover plate has a connection block mounted thereto at an opposite side of the expansion valve, the connection block having first and second penetration holes which communicate with the first inflow hole and the second exhaust hole, respectively.

2. The heat exchanger of claim 1, wherein the at least one space blocks the connection of the first flow channel and the first inflow hole to inject only an operation fluid that is discharged through the second exhaust hole.

3. The heat exchanger of claim 1, wherein the noise reducer comprises:

at least one noise reduction plate having one surface layered at the other surface of the heat exchange unit, the at least one noise reduction plate having a protruding end which protrudes toward the other surface of the heat exchange unit and having a connection hole which communicates with the second exhaust hole;

a resonance hole in which one side of the protruding end is opened to communicate with the connection hole; and a closing and sealing plate mounted to an outer side of the at least one noise reduction plate to be in contact with the protruding end and forming a space which communicates with the resonance hole between the closing and sealing plate and the at least one noise reduction plate.

4. The heat exchanger of claim 3, wherein the space blocks the connection of the first flow channel and the first inflow hole to inject only an operation fluid that is discharged through the second exhaust hole.

5. The heat exchanger of claim 1, wherein the expansion valve is connected to the heat exchange unit through a connection flange mounted to the heat exchange unit by a fixed plate, and the connection flange is integrally fixed to the heat exchange unit through a fixing bolt which penetrates the heat exchange unit from the other surface of the heat exchange unit.

6. The heat exchanger of claim 1, wherein the first inflow hole is formed at the other surface of the heat exchange unit, and the first exhaust hole is formed separately in a diagonal direction of the first inflow hole at the one surface of the heat exchange unit, and the second inflow hole is formed at the one surface of the heat exchange unit, and the second exhaust hole is formed separately in a diagonal direction of the second inflow hole at the other surface of the heat exchange unit.

7. The heat exchanger of claim 1, wherein the operation fluids include a first refrigerant having a high temperature and a high pressure that is discharged from a condenser to pass through each first flow channel through the first inflow hole, and a second refrigerant having a low temperature and a low pressure that is discharged from an evaporator to pass through each second flow channel through the second inflow hole.

* * * * *